US007542712B2

(12) United States Patent
Tanaka et al.

(10) Patent No.: US 7,542,712 B2
(45) Date of Patent: Jun. 2, 2009

(54) LUBRICANT APPLICATOR, AND IMAGE FORMING APPARATUS AND PROCESS CARTRIDGE USING THE LUBRICANT APPLICATOR, AND METHOD FOR ASSEMBLING THE PROCESS CARTRIDGE

(75) Inventors: Shuji Tanaka, Chigasaki (JP); Shinichi Kawahara, Setagaya-ku (JP); Yoshiyuki Kimura, Meguro-ku (JP); Hiroshi Hosokawa, Yokohama (JP); Yoshio Hattori, Kawasaki (JP); Takeo Suda, Katsushika-ku (JP); Yutaka Takahashi, Setagaya-ku (JP); Takatsugu Fujishiro, Taito-ku (JP); Teruyuki Kasuga, Atsugi (JP); Hiroomi Harada, Kawasaki (JP); Tokuya Ojimi, Kawasaki (JP); Masato Yanagida, Meguro-ku (JP); Takaaki Tawada, Yokohama (JP); Takeshi Tabuchi, Sagamihara (JP); Naohiro Kumagai, Machida (JP); Chohtaroh Kataoka, Kawasaki (JP); Hidemasa Sato, Sendai (JP)

(73) Assignee: Ricoh Company Limited, Tokyo (JP)

( * ) Notice: Subject to any disclaimer, the term of this patent is extended or adjusted under 35 U.S.C. 154(b) by 175 days.

(21) Appl. No.: 11/519,919

(22) Filed: Sep. 13, 2006

(65) Prior Publication Data

US 2007/0059067 A1 Mar. 15, 2007

(30) Foreign Application Priority Data

| | | |
|---|---|---|
| Sep. 14, 2005 | (JP) | 2005-266567 |
| Oct. 11, 2005 | (JP) | 2005-296193 |
| Oct. 17, 2005 | (JP) | 2005-301564 |
| Oct. 24, 2005 | (JP) | 2005-308238 |
| Nov. 22, 2005 | (JP) | 2005-337461 |
| Jul. 18, 2006 | (JP) | 2006-195142 |

(51) Int. Cl.
*G03G 21/00* (2006.01)

(52) U.S. Cl. ..... 399/346

(58) Field of Classification Search ..... 399/343, 399/346, 252

See application file for complete search history.

(56) References Cited

U.S. PATENT DOCUMENTS 4,904,558 A * 2/1990 Nagatsuka et al. ..... 430/122.8

(Continued)

FOREIGN PATENT DOCUMENTS

JP 2000-047523 * 2/2000

(Continued)

OTHER PUBLICATIONS

U.S. Appl. No. 12/014,557, filed Jan. 15, 2008, Harada.

(Continued)

*Primary Examiner*—Sandra L Brase
(74) *Attorney, Agent, or Firm*—Oblon, Spivak, McClelland, Maier & Neustadt, P.C.

(57) ABSTRACT

A process cartridge including an image bearing member; a lubricant applicator, which includes a lubricant application member configured to apply a solid lubricant to the surface of the image bearing member; and a smoothing member configured to smooth the applied solid lubricant, and at least one of a charging device, a developing device and a cleaning device, wherein the amount of the solid lubricant present on a portion of surface of the image bearing member, which is located between the lubricant application member and the smoothing blade, is from 0.11 to 1.2 mg/m$^2$. The smoothing member is preferably a blade having a JIS-A hardness of not less than 79°. The process cartridge is preferably assembled by a method including setting the lubricant smoothing member, the lubricant and the lubricant application member to a housing of the process cartridge; and then setting the image bearing member to the housing.

4 Claims, 24 Drawing Sheets

U.S. PATENT DOCUMENTS

| | | | | |
|---|---|---|---|---|
| 5,915,150 | A * | 6/1999 | Kukimoto et al. | 399/252 X |
| 6,558,862 | B2 * | 5/2003 | Kojima et al. | 399/346 X |
| 2005/0002705 | A1 * | 1/2005 | Shintani et al. | 399/346 |
| 2005/0152722 | A1 * | 7/2005 | Tawada et al. | 399/346 |
| 2005/0191099 | A1 * | 9/2005 | Yamaguchi et al. | 399/346 |
| 2005/0249533 | A1 | 11/2005 | Suda et al. | |
| 2006/0067727 | A1 | 3/2006 | Suda et al. | |

FOREIGN PATENT DOCUMENTS

| | | | |
|---|---|---|---|
| JP | 2000-330443 | | 11/2000 |
| JP | 2001-305907 | | 11/2001 |
| JP | 3347476 | | 9/2002 |
| JP | 3537307 | | 3/2004 |
| JP | 2004-354695 | | 12/2004 |
| JP | 2005-18047 | | 1/2005 |
| JP | 2005-70276 | | 3/2005 |
| JP | 2005-92019 | | 4/2005 |
| JP | 2005-092019 | * | 4/2005 |
| JP | 2005 092019 | | 4/2005 |

OTHER PUBLICATIONS

U.S. Appl. No. 11/853,529, filed Sep. 11, 2007, Kawahara, et al.

U.S. Appl. No. 12/210,715, filed Sep. 15, 2008, Takahashi et al.

* cited by examiner

LUBRICANT APPLICATOR, AND IMAGE FORMING APPARATUS AND PROCESS CARTRIDGE USING THE LUBRICANT APPLICATOR, AND METHOD FOR ASSEMBLING THE PROCESS CARTRIDGE

BACKGROUND OF THE INVENTION

1. Field of the Invention

The present invention relates to a lubricant applicator and more particularly, to a lubricant applicator which applies a lubricant on the surface of an image bearing member of an electrophotographic image forming apparatus. In addition, the present invention also relates to an electrophotographic image forming apparatus and a process cartridge, which include a lubricant applicator, and to a method for assembling the process cartridge.

2. Discussion of the Background

Recently, process cartridges including a unit of, for example, a photoreceptor and one or more of image forming devices such as charging devices, developing devices, and cleaning devices are broadly used for electrophotographic image forming apparatuses. Even when one or more image forming devices in a process cartridge of an image forming apparatus are damaged or the lives thereof expire, the image forming apparatus can be continuously used with a short downtime by replacing the process cartridge with new one. In this case, since only the replacing operation is necessary, the operation time of the serviceman is very short. Alternatively, a user may perform the replacing operation without calling a serviceman because the replacing operation is easy.

In order to produce high quality images using such process cartridges, it is necessary to assemble constituent members with high precision. Particularly, it is necessary to precisely contact a cleaning blade with a photoreceptor. Specifically, when a cleaning blade is not precisely contacted with a photoreceptor (for example, the pressure of the blade varies in the longitudinal direction thereof or the contact angle of the blade varies), defective cleaning is caused, resulting in formation of abnormal images such as white spots in solid or halftone images and grainy images (i.e., microscopically uneven density images).

In attempting to well remove toner particles remaining on the surface of a photoreceptor after a transfer process, a technique in that a lubricant is applied on the surface of the photoreceptor is used. For example, published unexamined Japanese patent application No. (hereinafter referred to as JP-A) 2005-070276 discloses an image forming apparatus which includes an image bearing member (i.e., photoreceptor), a charger configured to charge the photoreceptor, a light irradiator configured to irradiate the charged photoreceptor with imagewise light to form a latent image, a developing device configured to develop the latent image with a developer including a toner to form a toner image, a cleaner configured to clean the surface of the photoreceptor, a transfer device configured to transfer the toner image onto a receiving material optionally via an intermediate transfer medium, and a fixer configured to fix the toner image on the receiving material, wherein a lubricant applicator is provided between the cleaner and the charger to apply a lubricant on the surface of the photoreceptor, i.e., to decrease the friction coefficient of the surface of the photoreceptor, thereby increasing the transfer rate of toner images.

JP-A 2005-018047 discloses an image forming apparatus including a cleaner configured to remove and collect toner particles remaining on the surface of a moving member, and a lubricant applicator configured to apply a lubricant on the surface of the moving member to decrease the friction coefficient thereof. The lubricant applicator is provided outside the cleaner and has a casing whose edges form an opening. The edges of the casing are contacted with the surface of the moving member to apply a lubricant, which is contained in the casing, to the surface of the moving member.

JP-A 2001-305907 discloses an image forming apparatus in attempting to prevent formation of abnormal images such as omissions, blurred images and grainy images. The image forming apparatus has an endless image bearing member configured to bear a toner image thereon, an intermediate transfer medium configured to receive the toner image from the image bearing member (primary transfer process), and a transfer device configured to transfer the toner image on the intermediate transfer medium to a receiving material (secondary transfer process). The image forming apparatus further includes a lubricant applicator configured to apply a lubricant to the surface of the surface of at least one of the image bearing member and the intermediate transfer medium, before a toner image is formed on the surface; a cleaner configured to clean the surface before the lubricant is not applied on the surface; and a smoother configured to smooth the applied lubricant.

On the other hand, in order to produce high quality images, recent image forming apparatuses include a charger applying a DC voltage overlapped with an AC voltage and use a developer including a polymerization toner. When such a charger is used, a problem in that a film of toner is formed on the surface of a photoreceptor tends to occur. In attempting to solve the problem, a lubricant such as zinc stearate is applied on the surface of the photoreceptor. When a polymerization toner is used, it is difficult to remove residual toner particles from the surface of a photoreceptor with a cleaning blade. Specifically, even when the edge of the blade is slightly damaged, abnormal images are formed. If a lubricant, a brush roller serving as the lubricant applicator and a lubricant smoother are not accidentally provided in an image forming apparatus or a process cartridge, abnormal images are formed and therefore the process cartridge has to be replaced with a new process cartridge.

When abnormal images are formed due to damage of the edge of a cleaning blade, the cleaning blade has to be replaced with a new blade. Therefore, in order to prevent formation of abnormal images, it is preferable to prevent the cleaning blade, lubricant applicator and lubricant smoother from being damaged, resulting in prevention of damaging of the photoreceptor.

It is well known that although there is a case where a photoreceptor serving as an image bearing member is damaged when image forming operations are repeatedly performed thereon, the photoreceptor is typically damaged by other devices when a process cartridge including the photoreceptor and the devices is assembled. The above-mentioned JP-As 2005-070276, 2005-018047 and 2001-305907 never discuss the point.

As a result of the present inventors' study, it is found that it is difficult to form a uniform lubricant layer only by coating a lubricant on the surface of a photoreceptor and then smoothing the coated layer with a blade. When an uneven lubricant layer is formed, the friction coefficient of the surface of the image bearing member tends to vary, resulting in formation of abnormal images such as omissions, blurred images and grainy images.

Techniques in that a lubricant is applied to the surface of a photoreceptor on an upstream side from a cleaner relative to the rotation direction of the photoreceptor are known. In this case, the applied lubricant is smoothed with the cleaner. However, the techniques have a drawback in that the quantity of the lubricant on an image forming area (on which residual toner particles are present) is different from that on a non-image area (on which residual toner particles are not present) because the lubricant adhered to the toner particles is removed from the surface. Therefore, it is hard to control the quantity of lubricant present on the surface of the photoreceptor.

Techniques in that a lubricant is applied to the surface of a photoreceptor on a downstream side from a cleaner relative to the rotation direction of the photoreceptor and a smoothing device is optionally are also well known. In this case, the problem in that the lubricant is mixed with residual toner particles can be avoided.

JP-A 2000-330443 discloses a technique in that a lubricant to be applied is set so as to be sandwiched by a cleaning blade and a smoothing member. The smoothing member is a polyurethane blade and is set under the conditions such that the smoothing member counters the image bearing member and the contact pressure and angle are 1.37 g/mm and 11.7°, respectively. The cleaning member is a polyurethane blade and is set under the conditions such that the cleaning member counters the image bearing member and the contact pressure and angle are 2.97 g/mm and 9.6°, respectively.

JP-A 2001-305907 discloses a technique in that a lubricant applicator is set on a downstream side from a cleaner relative to the rotation direction of the photoreceptor and a smoothing blade is set on a downstream side from the lubricant applicator so as to trail the photoreceptor.

JP-A 2004-354695 discloses a technique in that a lubricant applicator is set on a downstream side from a cleaner relative to the rotation direction of the photoreceptor and a smoothing brush is set on a downstream side from the lubricant applicator.

Because of these reasons, a need exists for a lubricant applicator which can uniformly apply a lubricant to the surface of an image bearing member, and a process cartridge which includes a photoreceptor and a lubricant applicator and which can be assembled without damaging the photoreceptor.

SUMMARY OF THE INVENTION

As one aspect of the present invention, a process cartridge is provided in which at least an image bearing member, a lubricant applicator including a lubricant application member configured to apply a solid lubricant to the surface of the photoreceptor, and a lubricant smoothing member configured to smooth the applied lubricant, and at least one member selected from the group consisting of a charging device configured to charge the photoreceptor, a developing device configured to form a toner image on the image bearing member, and a cleaning device configured to clean the surface of the image bearing member are unitized, wherein the amount of the lubricant present on a portion of the surface of the image bearing member, which is located between the lubricant application member and the smoothing member, is from 0.11 to 1.2 g/m$^2$.

As another aspect of the present invention, a method for assembling a process cartridge in which at least a housing, an image bearing member, a lubricant application member configured to apply a lubricant to the surface of the photoreceptor, a lubricant smoothing member configured to smooth the applied lubricant, and at least one member selected from the group consisting of a charging device configured to charge the photoreceptor, a developing device configured to develop a latent image on the photoreceptor with a developer to form a visual image, and a cleaner configured to clean the surface of the photoreceptor are unitized, including:

setting the lubricant smoothing member, the lubricant and the lubricant application member to the housing; and then setting the photoreceptor to the housing.

It is preferable that in the first-mentioned setting process, the lubricant smoothing member is set at first, and then the lubricant and the lubricant application member are set.

As yet another aspect of the present invention, a lubricant applicator is provided which includes a solid lubricant, a lubricant application member configured to applied the lubricant to the surface of an image bearing member, and a smoothing blade configured to smooth the applied lubricant, wherein the smoothing blade has a JIS-A hardness of not less than 79°.

As a further aspect of the present invention, an image forming apparatus is provided which includes an image bearing member, a toner image forming device configured to form a toner image on a surface of the image bearing member, a cleaning device configured to clean the surface of the image bearing member after the toner image is transferred, and the above-mentioned lubricant applicator configured apply a solid lubricant to the surface of the image bearing member, wherein the amount of the lubricant present on a portion of the surface of the image bearing member, which is located between the lubricant application member and the smoothing member, is from 0.11 to 1.2 g/m$^2$.

These and other objects, features and advantages of the present invention will become apparent upon consideration of the following description of the preferred embodiments of the present invention taken in conjunction with the accompanying drawings.

DETAILED DESCRIPTION OF THE INVENTION

An embodiment of the image forming apparatus of the present invention will be explained referring to FIG. 1.

Figure 1:
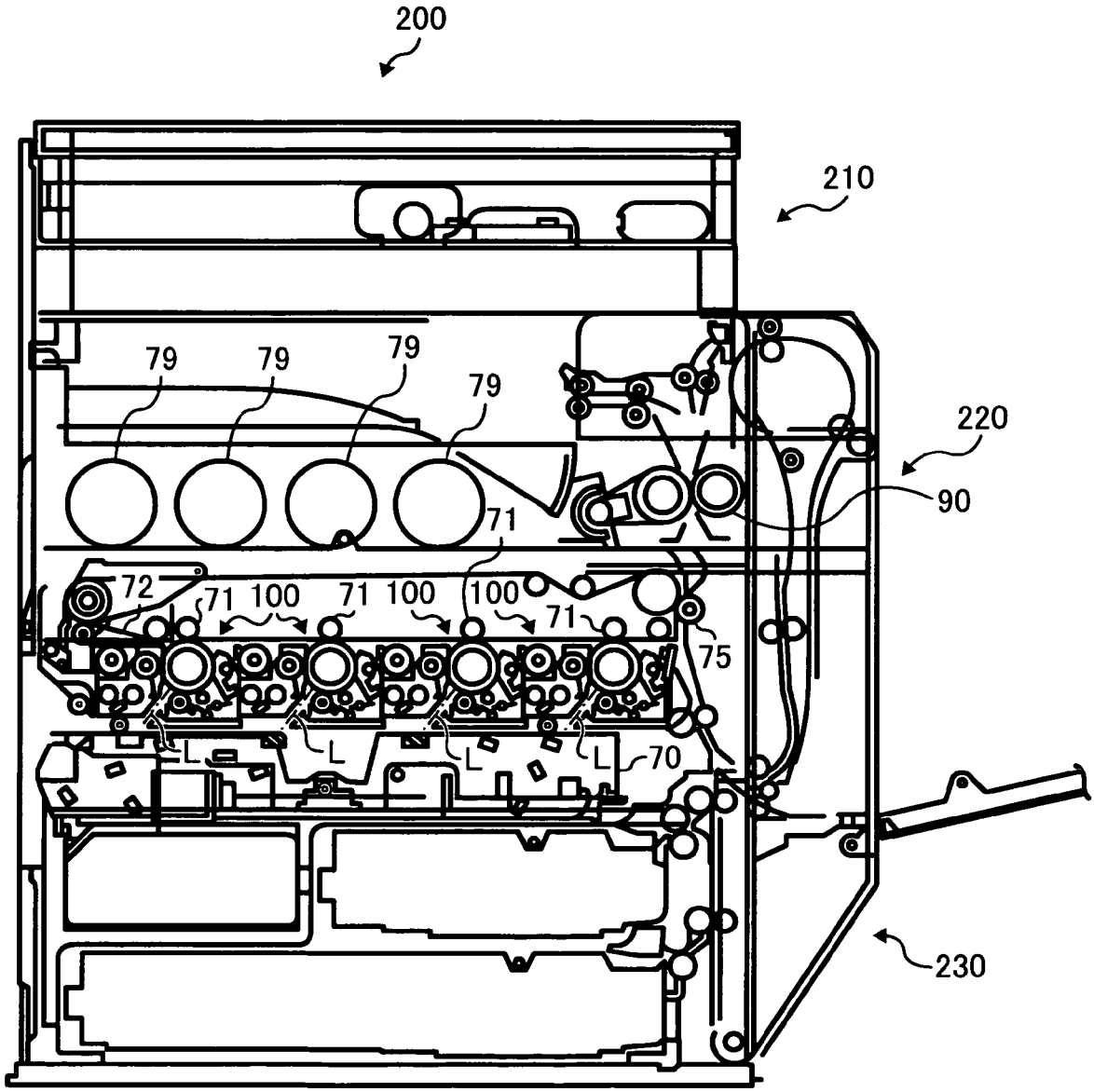
FIG. 1 is a schematic view illustrating an embodiment of the image forming apparatus of the present invention.

FIG. 1 illustrates the cross section of a full color image forming apparatus.

Referring to FIG. 1, an image forming apparatus 200 includes a reading section 210 configured to read an original image, an image forming section 220, and a receiving material containing and feeding section 230. The image forming section includes four process cartridges 100 (for forming yellow (Y), cyan (C), magenta (M) and black (K) images), which are arranged side by side in the main body of the image forming apparatus, an endless intermediate transfer belt 72 serving as an intermediate transfer medium, a secondary transfer roller 75 configured to transfer a toner image on the intermediate transfer belt to a receiving material, toner bottles 79 configured to supply different color toners to the respective process cartridges 100, etc.

Different color toner images formed on four photoreceptors 10 are transferred on the intermediate transfer belt 72 while overlaid. The configurations and operations of the four process cartridges 100 are substantially the same except that the color of the toner is different from each other.

Figure 2:
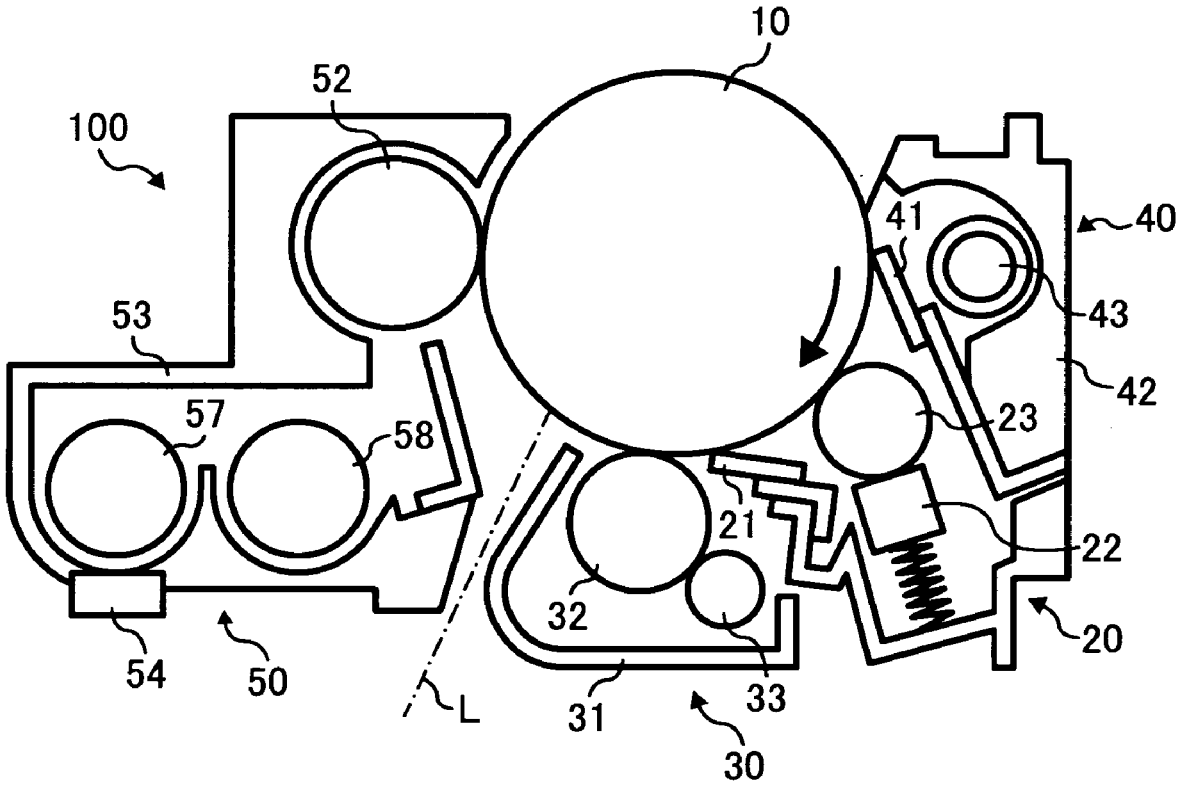
FIG. 2 is a schematic view illustrating an embodiment of the process cartridge of the present invention.

FIG. 2 illustrates the cross section of the process cartridge 100. The process cartridge 100 includes a photoreceptor 10 serving as an image bearing member. Around the photoreceptor 10, a cleaning module 40 serving as a cleaner, a lubricant application module 20 serving as a lubricant applicator, a charging module 30 serving as a charger, and a developing module 50 serving as a developing device are arranged.

The charging module 30 includes a charging device 31 including a charging roller 32, which serves as a charging member and is arranged so as to face the surface of the photoreceptor 10, and a charging roller cleaner 33 configured to clean the surface of the charging roller 32.

The charging roller 32 uniformly charges the surface of the photoreceptor 10. Specific examples of the charging devices 31 include non-contact charging devices such as scorotron chargers and corotron chargers, which use a charge wire; contact chargers which contact a rubber roller having a medium resistance with the surface of the photoreceptor; and short range chargers which use a roller set closely to the photoreceptor. The charging device 31 illustrated in FIG. 2 is a short range charger.

Scorotron chargers have been broadly used for negatively charging photoreceptors, but have a drawback in that a large amount of ozone is generated. Therefore, recently scorotron chargers are used only for limited applications. Corotron chargers positively charge photoreceptors. Although the amount of ozone generated by corotron chargers is small, the chargers are not used popularly.

Recently, contact roller charging methods and non-contact roller charging methods are mainly used for electrophotographic image forming apparatuses because the manufacturing costs of charging rollers are reduced. The roller charging methods are classified into DC/AC charging methods in which a DC voltage overlapped with an AC voltage is applied to a photoreceptor and DC charging methods in which only a DC voltage is applied to a photoreceptor. When DC/AC charging methods are used, high quality images can be produced, but a filming problem in that a toner film is formed on a photoreceptor is easily caused.

Use of DC/AC charging methods for contact roller charging methods brings an advantage such that the potential of a photoreceptor is hardly influenced by change of resistance of the charging roller due to change of environmental conditions by performing constant AC current controlling, but has disadvantages such that the costs of the power source increases and noise due to an alternating high frequency wave is generated.

When only a DC voltage is used, the potential of a photoreceptor is seriously influenced by change of resistance of the charging roller due to change of environmental conditions. Therefore, it is necessary to provide any applied voltage compensation device when DC charging methods are used.

When DC/AC charging methods are used for non-contact roller charging methods, images with uneven image density are formed if the gap between the photoreceptor and the charger changes. Therefore, it is necessary to provide any applied voltage compensation device similarly to the case where only a DC voltage is applied. Non-contact roller charging methods have an advantage in that degree of contamination of the charging roller with toner particles, etc. is lower than that in the contact charging methods. In order to apply a proper voltage, a device which detects the temperature at a position near the charging roller and changes the applied voltage, and a device which periodically detects the degree of contamination of the surface of the photoreceptor and changes the applied voltage are used. By using such devices, the potential of the photoreceptor can be controlled so as to be from about −500V to about −700V.

The method for driving the charging roller 32 is broadly classified into a driving method in which the charging roller 32 is contacted with photoreceptor 10 to be driven, or a driving method in which the charging roller is driven by a gear rotating the photoreceptor 10. The former method is typically used for low speed image forming apparatuses. The latter method is typically used for high speed image forming apparatuses or image forming apparatuses that are required to produce high quality images.

When the charging roller is contaminated, the charging ability of the contaminated portion deteriorates, and thereby the potential of a portion of the photoreceptor facing the contaminated portion is decreased, resulting in formation of abnormal images. In order to prevent formation of such abnormal images, the charging roller cleaner 33 is contacted with the charging roller 32. The charging roller cleaner is typically made of a melamine resin, and is driven by the charging roller 32 without receiving any particular driving force to clean the surface of the charging roller 32.

The developing device 50 serving as the developing module includes a developing roller 52 configured to supply a developer including a toner to the photoreceptor 10. A toner concentration sensor 54 is provided on a developer container 53 containing the developer therein. The toner sensor 54 is arranged on a bottom of a passage through which the developer including the toner and a carrier is circulated, and sends information concerning the toner concentration to the main body of the image forming apparatus. The toner concentration sensor 54 is connected with the main body by a connector to send data to the main body.

A waste toner collection coil 43 (i.e., a toner feeding auger) is arranged in the vicinity of a cleaning blade 41 of the cleaning module 40. After the waste toner collected by the cleaning blade 41 is contained in a toner containing portion 42, the waste toner is fed by the waste toner collection coil 43 to be collected.

Numerals 57 and 58 denote an agitation roller configured to agitate the developer and a supply roller configured to supply the developer to the developing roller 52, respectively.

The cleaning blade 41 is preferably made of a urethane rubber and is contacted with the surface of the photoreceptor 10 so as to counter the rotating photoreceptor. Thus, toner particles remaining on the surface of the photoreceptor 10 are scraped off by the edge of the cleaning blade 41. The toner particles are fed by the waste toner collection coil 43 to a waste toner tank (not shown). In this embodiment, the thus collected waste toner is not reused. Polymerization toners, which have been mainly used recently, have little margin for blade cleaning because of having a particle form near spherical form. Therefore, it is necessary to stably contact the blade 41 with the surface of the photoreceptor 10 with high precision. Recently, the average particle diameter of the toner used for developing becomes smaller and smaller to produce high quality images. Therefore, even when a slightly damaged cleaning blade is used, abnormal images (e.g., streak images) are formed due to defective cleaning.

The lubricant application module 20 is arranged between the cleaning module 40 and the charging module 30. The lubricant application module 20 includes a solid lubricant 22, a brush roller 23 (serving as a lubricant application member) configured to apply the solid lubricant 22 on the surface of the photoreceptor 10, and a smoothing blade 21 (serving as a lubricant smoothing member) configured to smooth the coated lubricant. The lubricant is coated on the surface of the photoreceptor 10 to control the friction coefficient of the surface of the photoreceptor 10 so as to be fall in a relatively low range, resulting in prevention of formation of a film (such as a toner film) on the surface of the photoreceptor 10.

The solid lubricant 22 is pressure-contacted with the brush roller 23. Therefore, the surface of the lubricant 22 is scraped by the brush roller 23, and the resultant lubricant powder is coated on the surface of the photoreceptor 10. The lubricant on the surface of the photoreceptor 10 is smoothed by the smoothing blade 21, resulting in formation of a uniform thin film of the lubricant. The smoothing blade 21 can be set on the surface of the photoreceptor 10 so as to counter or trail the photoreceptor. However, it is preferable that the smoothing blade 21 is set to trail the photoreceptor as illustrated in FIG. 2. The brush roller 23 is preferably made of a material such as insulating PET (polyethylene terephthalate) fibers, electroconductive PET fibers and acrylic fibers.

Next, the operations of the image forming apparatus 200 including the process cartridge 100 will be explained.

Referring to FIGS. 1 and 2, the photoreceptor 10 is clockwise rotated, and is charged with the charging device 31 to have the target potential with the predetermined polarity. An optical writing device 70 irradiates the charged photoreceptor 10 with a laser beam L, which has been modulated with image information, to form an electrostatic latent image on the surface of the photoreceptor 10.

The developing device 50 develops the electrostatic latent image with the developer including a toner to visualize the latent image using the toner. Thus, different color toner images are formed on the surface of the respective photoreceptors 10. The thus formed color toner images are transferred to the intermediate transfer belt 72 one by one by primary transfer rollers 71 which are arranged so as to face the respective photoreceptors with the intermediate transfer medium 72 therebetween and to which a transfer voltage is applied. Thus, color toner images are overlaid on the surface of the intermediate transfer belt 72, resulting in formation of a multi-color image.

Toner particles remaining on the surface of the photoreceptor 10 are removed therefrom by the cleaning blade 41. The solid lubricant 22 is applied on the thus cleaned surface of the photoreceptor 10 using the brush roller 23, and the coated lubricant is smoothed by the smoothing blade 21. Thus, the friction coefficient of the surface of the photoreceptor is decreased, resulting in improvement of the cleanability of the photoreceptor 10.

The multi-color image formed on the intermediate transfer medium 72 is transferred on a receiving material. Specifically, as illustrated in FIG. 1, the receiving material containing and feeding section 230 has a paper feeding cassette configured to contain sheets of the receiving material (such as papers), which is located in the bottom of the main body of the image forming apparatus. An uppermost sheet of the receiving material in the cassette is timely fed to the transfer nip between the intermediate transfer belt 72 and the secondary transfer roller 75, to which a transfer bias is applied by a power source (not shown). Therefore, the multi-color toner image on the intermediate transfer medium is secondarily transferred onto the receiving sheet.

The receiving sheet bearing the toner image is then fed to a fixing device 90, which applies heat and pressure to the image to fix the toner image on the receiving sheet. The receiving sheet on which the multi-color image is fixed is then discharged by a pair of discharge rollers to a discharge tray located on an upper portion of the image forming apparatus 200.

In this embodiment, the modular cleaner, charger and developing device are used. Therefore, it is possible that after the process cartridge is detached from the image forming apparatus, each of the cleaner, charger and developing device can be independently replaced with new one. Thus, it is possible to replace only a damaged device, and therefore consumption of resources can be reduced. In addition, the process cartridge is very convenient because users or service men merely replace a damaged device or entire the process cartridge with new one.

Next, the method for assembling the process cartridge of the present invention will be explained referring to FIGS. 3-16.

Figure 3:
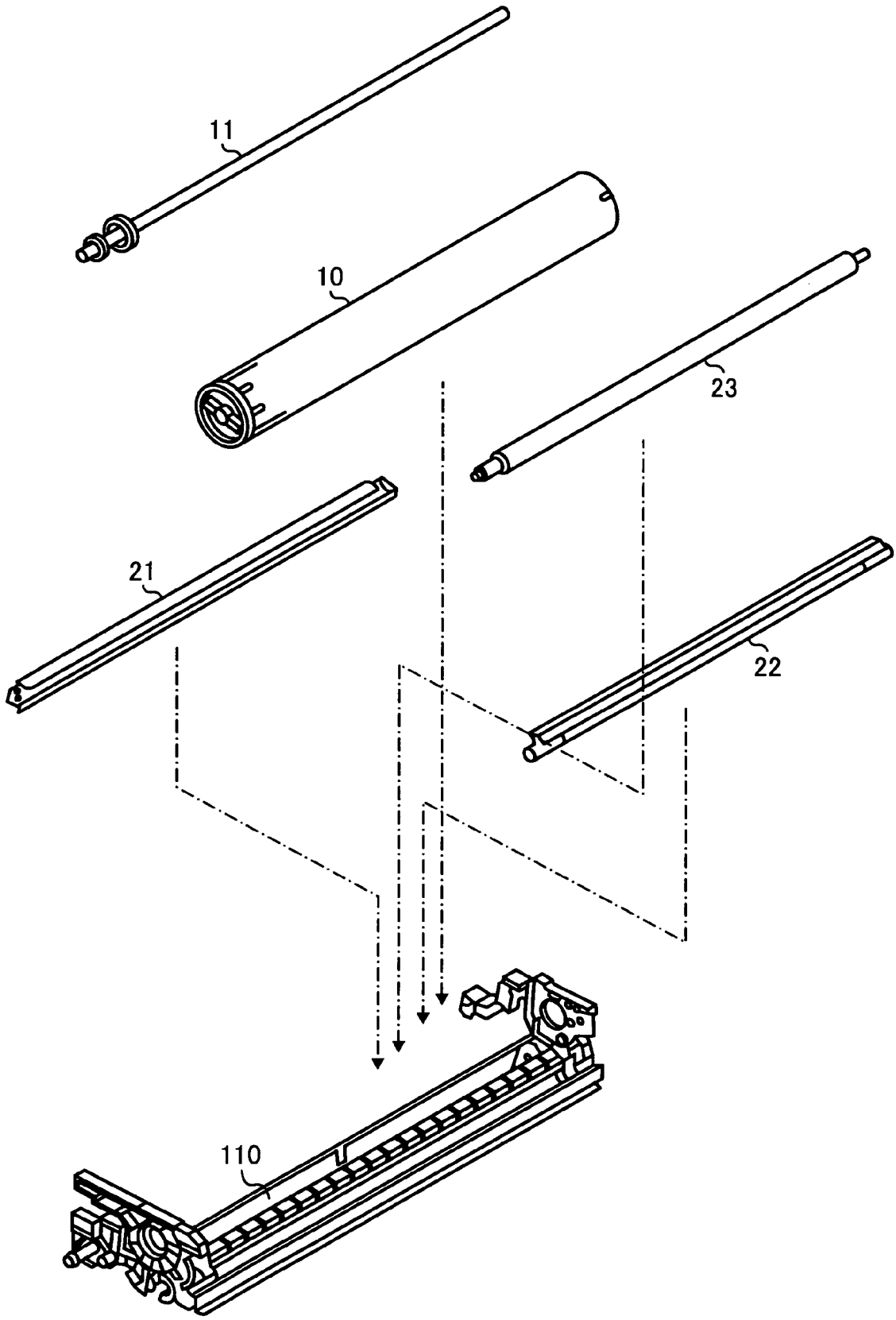
FIGS. 3-5 are schematic views for explaining how the process cartridge illustrated in FIG. 2 is assembled.

FIG. 3 is a view for explaining the way to assemble the process cartridge of the present invention. As illustrated in FIG. 3, the process cartridge is mainly constituted of a housing 110, and the photoreceptor 10, a rotation shaft 11 of the photoreceptor, the smoothing blade 21, the solid lubricant 22 and the brush roller 23, which are to be incorporated in the housing 110.

Figure 4:
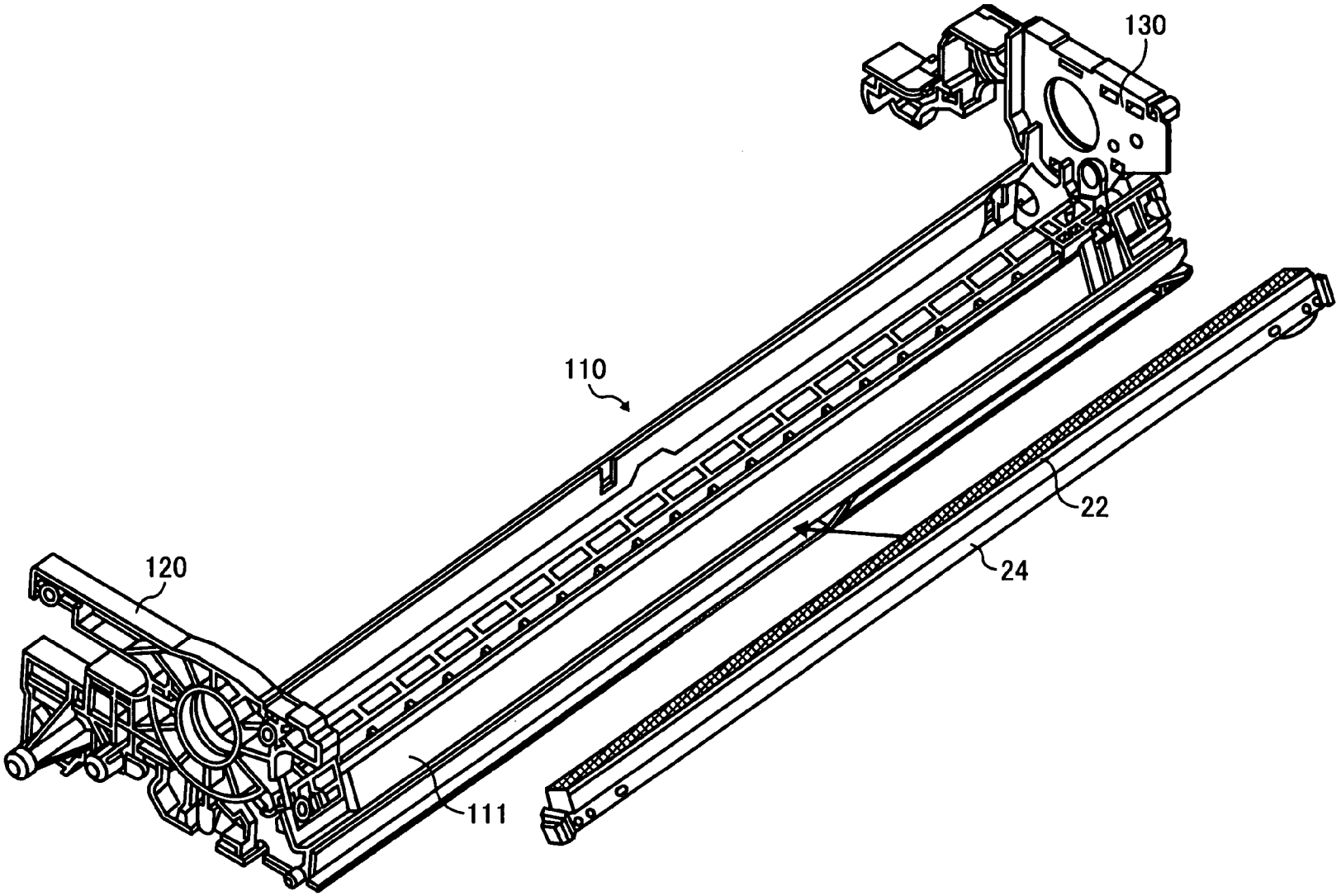
Figure 5:
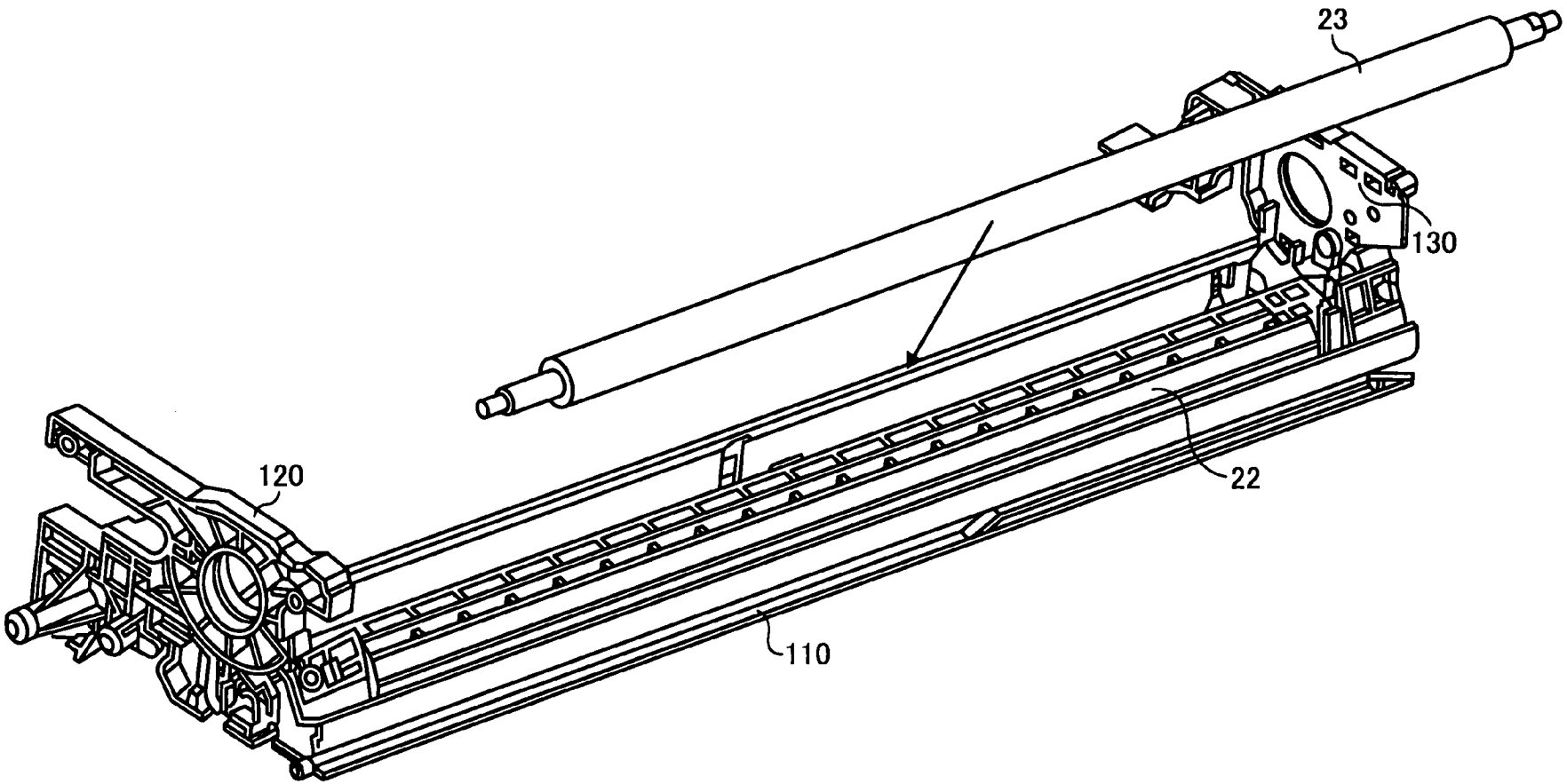
Figure 6:
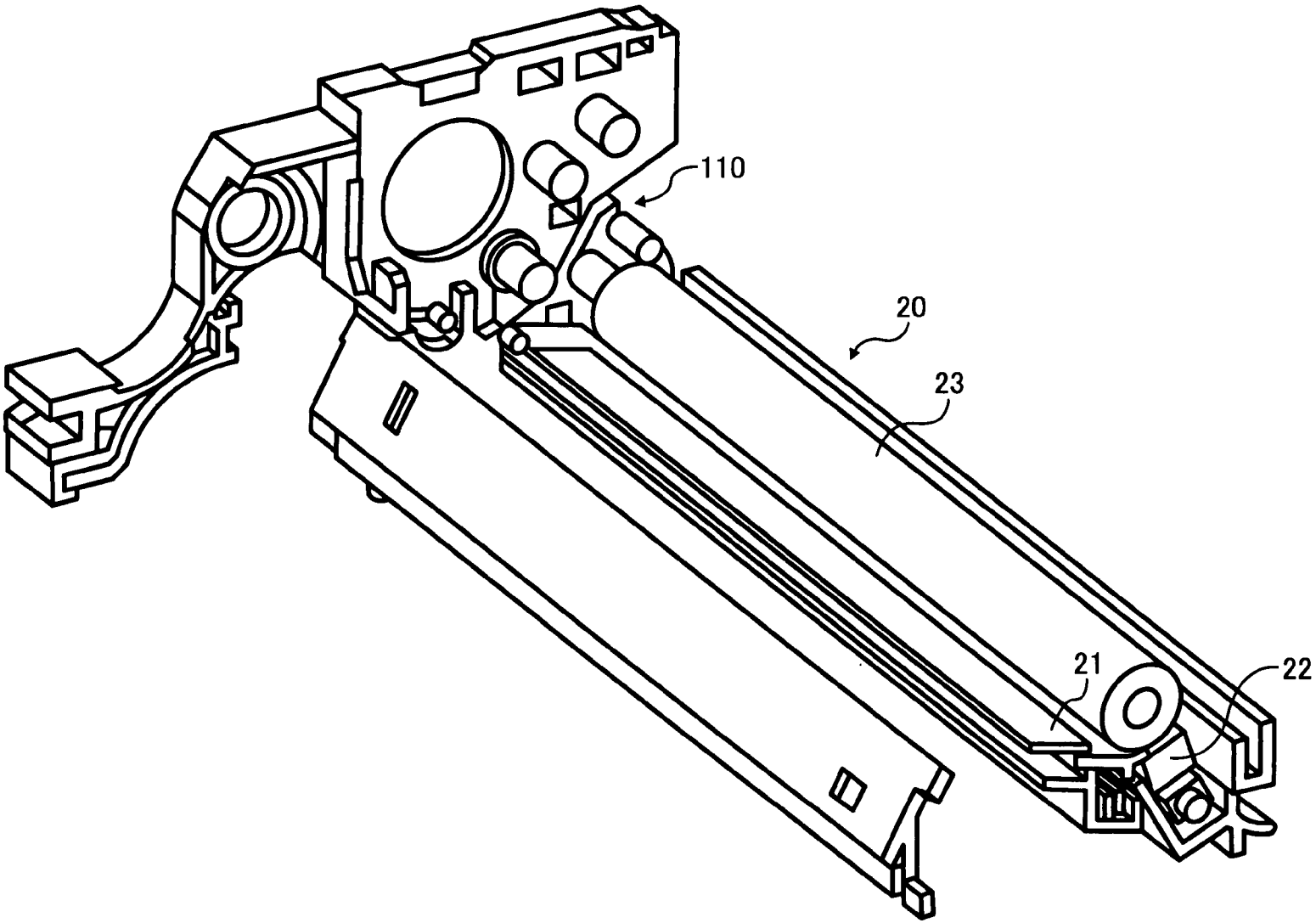
FIG. 6 is a schematic view illustrating a process cartridge in which the lubricant application module is set.

As illustrated in FIG. 4, when the process cartridge is assembled, at first the solid lubricant 22 supported by a lubricant support 24 is engaged with a lubricant containing portion 111 provided on the housing 110. Next, as illustrated in FIG. 5, the brush roller 23 is attached to the housing 110 from above the lubricant 22. As illustrated in FIG. 6, the smoothing blade 21 is then attached thereto, and the lubricant application module is then attached thereto. Thus assembling of the process cartridge is completed. FIG. 6 is a perspective view illustrating the housing 110 into which the lubricant module 20 is incorporated.

Next, the photoreceptor 10 is incorporated into the housing 110 into which the lubricant application module 20 has been already incorporated. Specifically, one edge of a rotation shaft 11 (illustrated in FIG. 12) of the photoreceptor 10, which edge does not have a bearing, is inserted into a bearing provided on a first side plate 120 of the housing 110. After the rotation shaft 11 passes through the photoreceptor, the another edge of the rotation shaft 11 (illustrated in FIG. 5) is inserted into a bearing provided on a second side plate 130 (illustrated in FIG. 5) of the housing 110 so that the bearing provided on the edge of the rotation shaft 11 is engaged with the bearing of the second side plate 130. Thus, the photoreceptor 10 is rotatably fixed to the housing 110.

Figure 7:
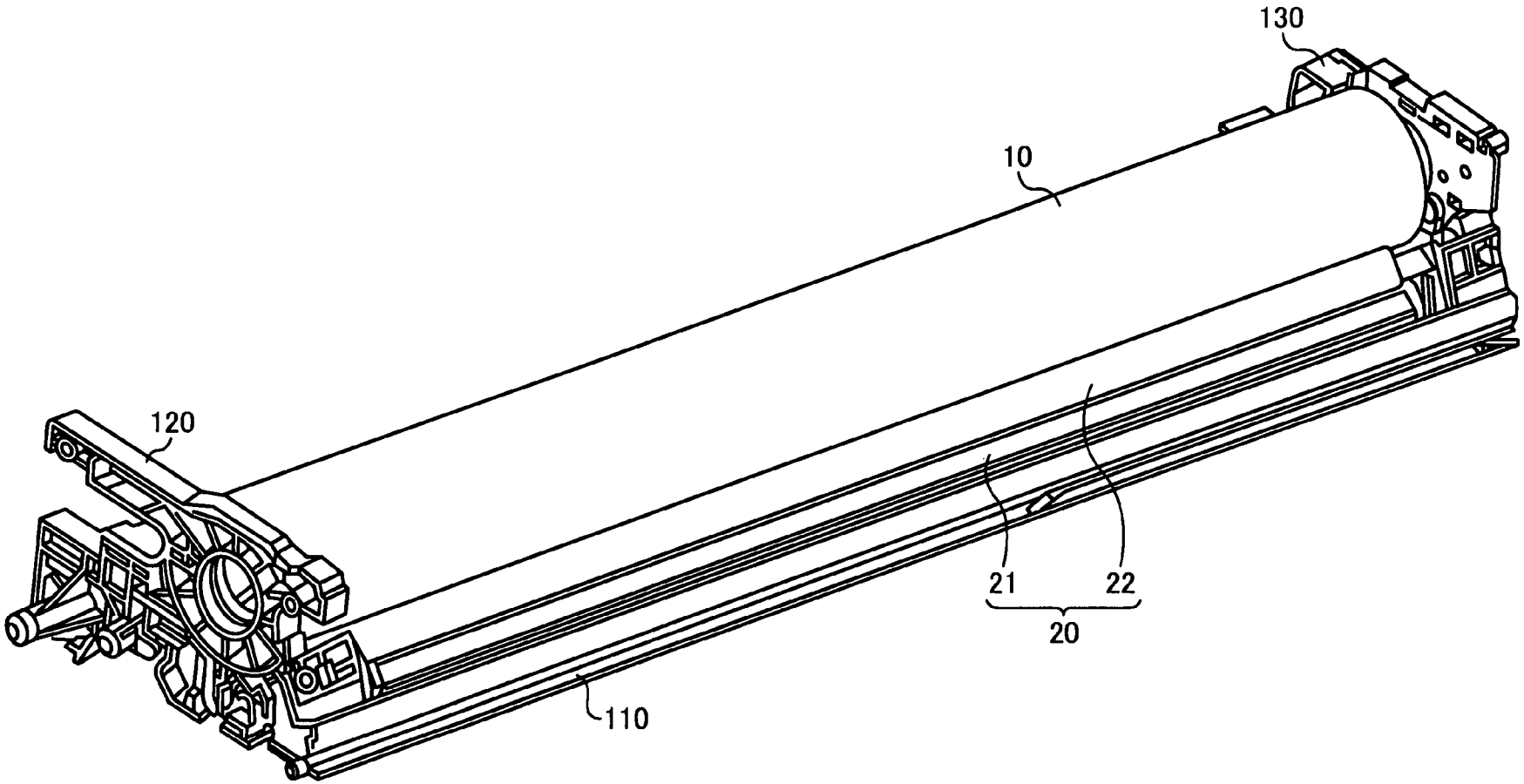
FIG. 7 is a schematic view illustrating a process cartridge in which both the lubricant application module and the photoreceptor are set.

FIG. 7 is a schematic perspective view illustrating the housing 110 into which the lubricant application module 20 and the photoreceptor 10 are incorporated.

Since the photoreceptor 10 is incorporated into the housing 110 after the lubricant application module 20 is incorporated into the housing 110, only the smoothing blade 21 is to be contacted with the surface of the photoreceptor 10 when the photoreceptor is set. When both the cleaning blade and the smoothing blade are incorporated before incorporating the photoreceptor, the probability that the tips of the blades are damaged or deformed increases. In other words, it is necessary only to carefully set the photoreceptor so as not to damage the smoothing blade 21. Therefore, the probability that the tip of the smoothing blade is damaged or deformed is much lower than in the case where a photoreceptor is set after two blades are incorporated.

Figure 8:
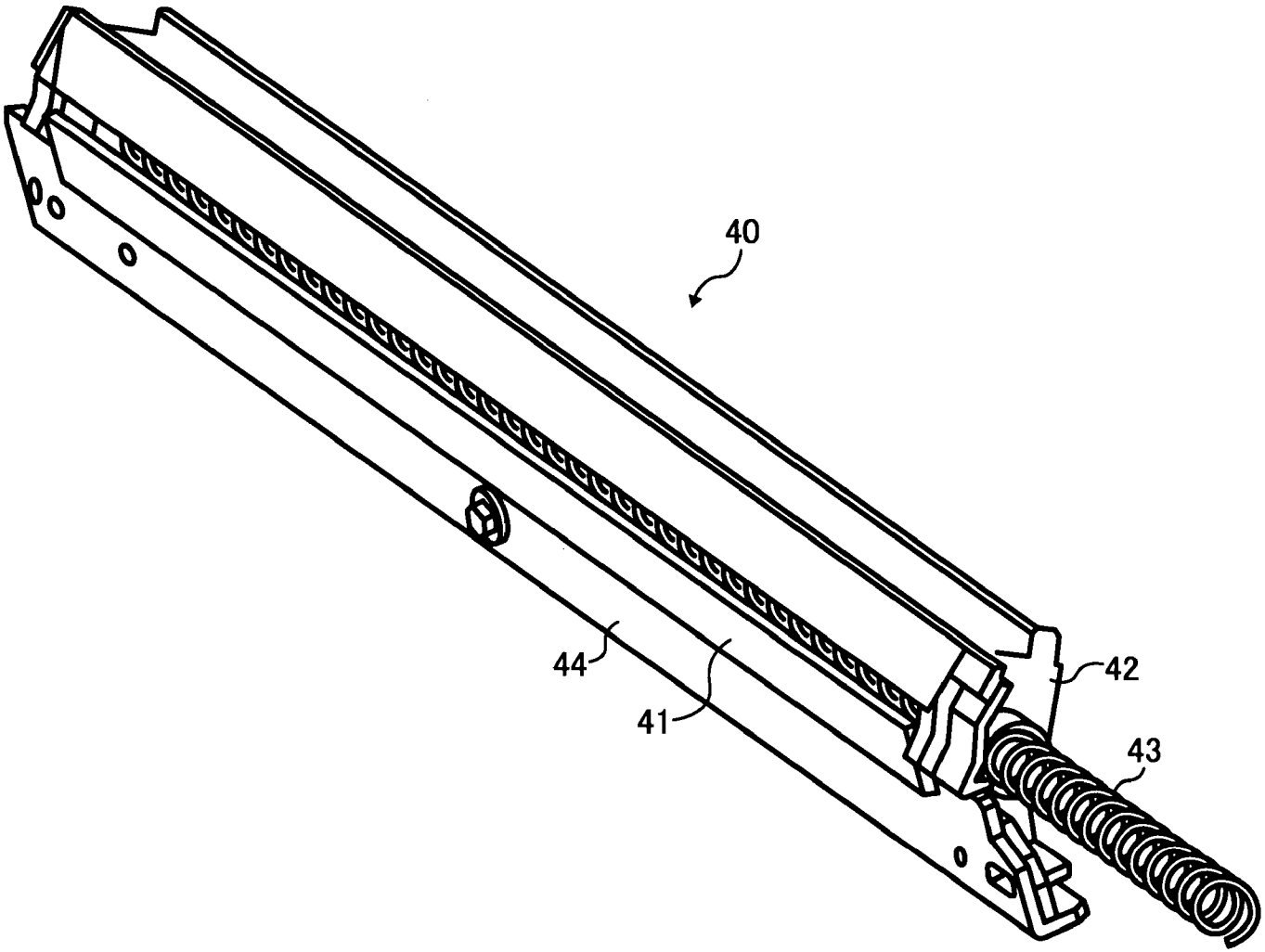
FIGS. 8-10 are perspective views illustrating a cleaning module, a developing module and a charging module, respectively.
Figure 9:
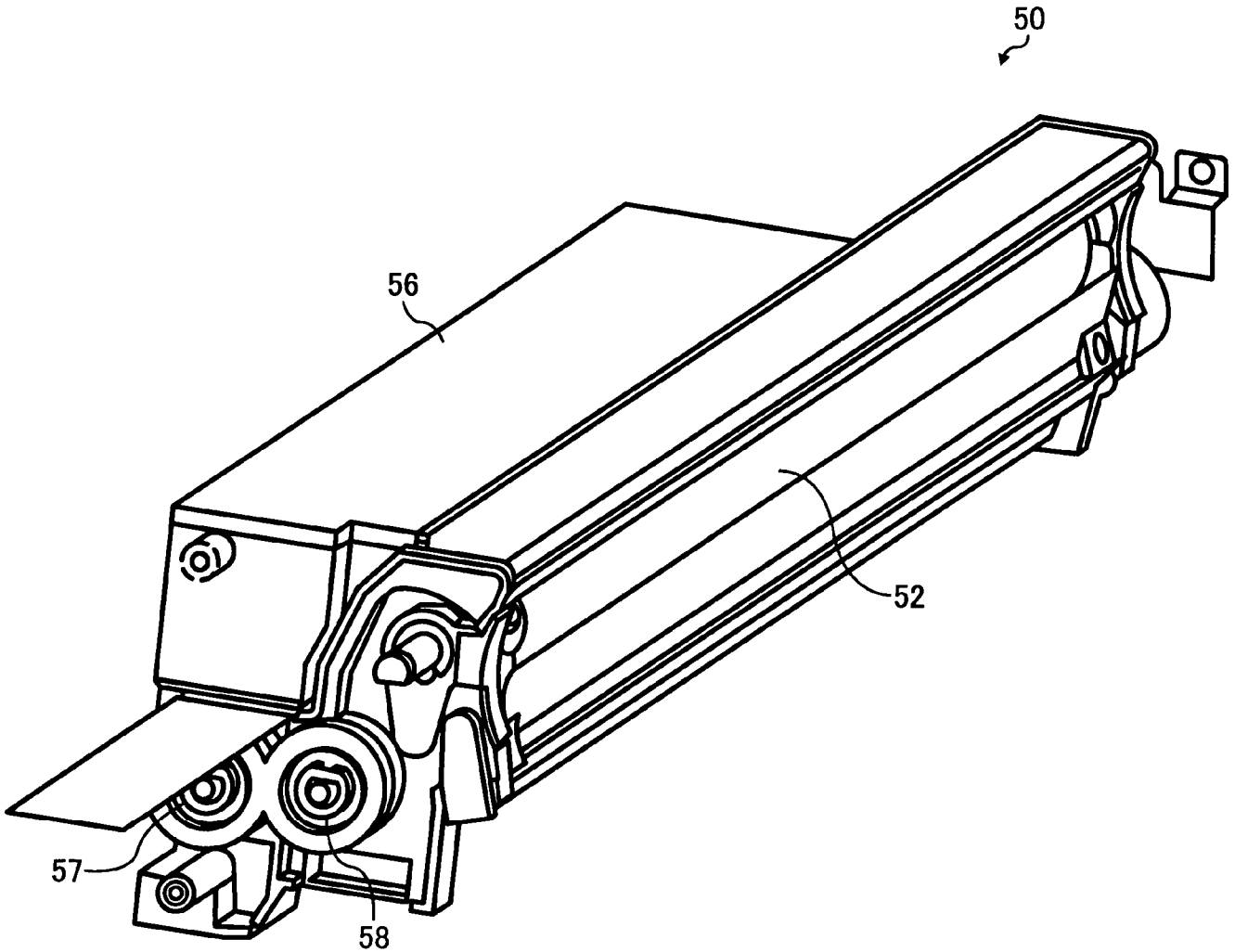
Figure 10:
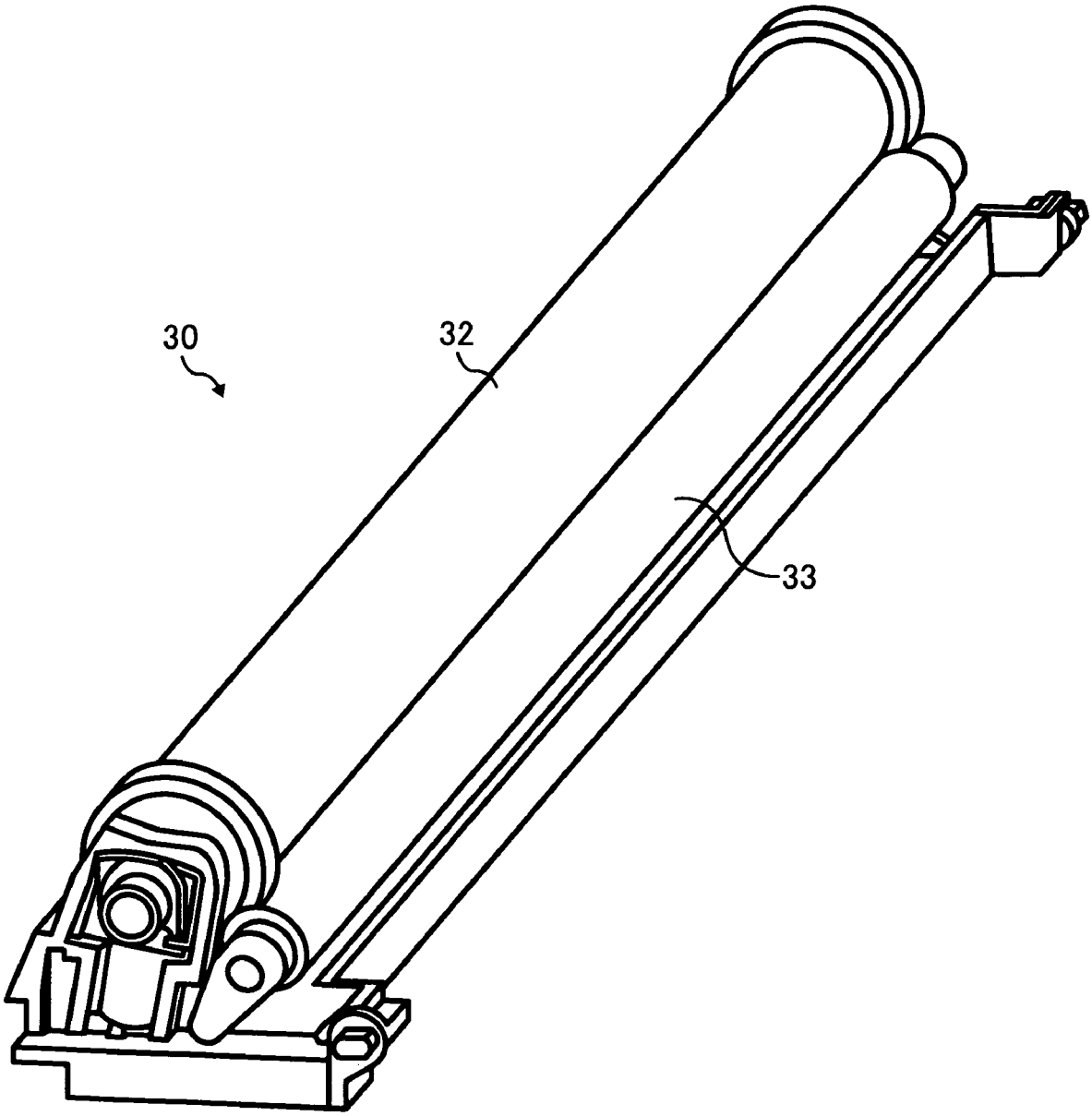

Other process units such as cleaning modules, charging modules and developing modules can be incorporated. FIGS. 8-10 are perspective views illustrating the cleaning modules 40, the developing modules 50 and charging modules 30, respectively.

Referring to FIG. 8, the cleaning module 40 includes the cleaning blade 41, the toner containing portion 42 configured to store the collected toner, the waste toner collection coil 43 (i.e., the feeding auger), and a support plate 44 which is used for incorporating the cleaning module 40 into the process cartridge.

Referring to FIG. 9, the developing module 50 includes the developing roller 52 configured to supply the developer to the surface of the photoreceptor 10, a developer containing portion 56, and the agitation roller 57 and the supply roller 58 (illustrated in FIG. 2), both of which are provided in the developer containing portion 56.

Referring to FIG. 10, the charging module 30 includes the charging roller 32 configured to uniformly charge the surface of the photoreceptor 10, the charging roller cleaner 33 configured to clean the surface of he charging roller 32.

Figure 13:
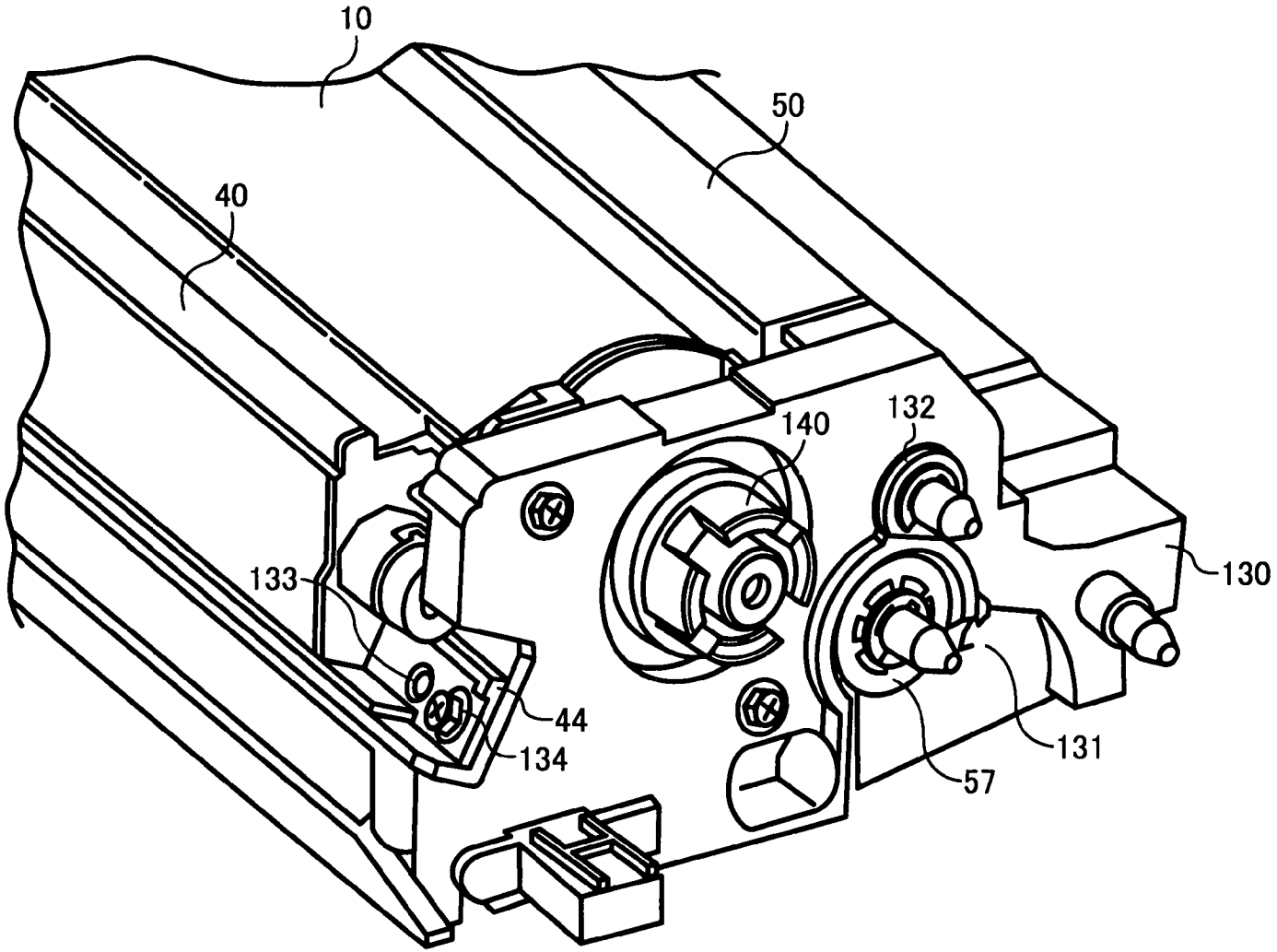

The assembling order of the cleaning module 40, developing module 50 and charging module 30 is not particularly limited. For example, after the cleaning module 40 is incorporated, the charging module 30 and developing module 50 are incorporated. The way to incorporate the cleaning module 40 into the housing 110 will be explained referring to FIGS. 13 and 8. As illustrated in FIG. 13, at first the support plate 44 of the cleaning module 40 (illustrated in FIG. 8) is positioned using a positioning projection 133. The support plate 44 is fixed to the housing using a screw 134. By using this method, the cleaning module 40 can be incorporated while positioned with high precision. In this regard, the support plate 44 is preferably fixed to the housing 110 at both the ends of the housing. By using this fixing method, the cleaning blade 41 can be set with high precision relative to the photoreceptor 10.

Figure 11:
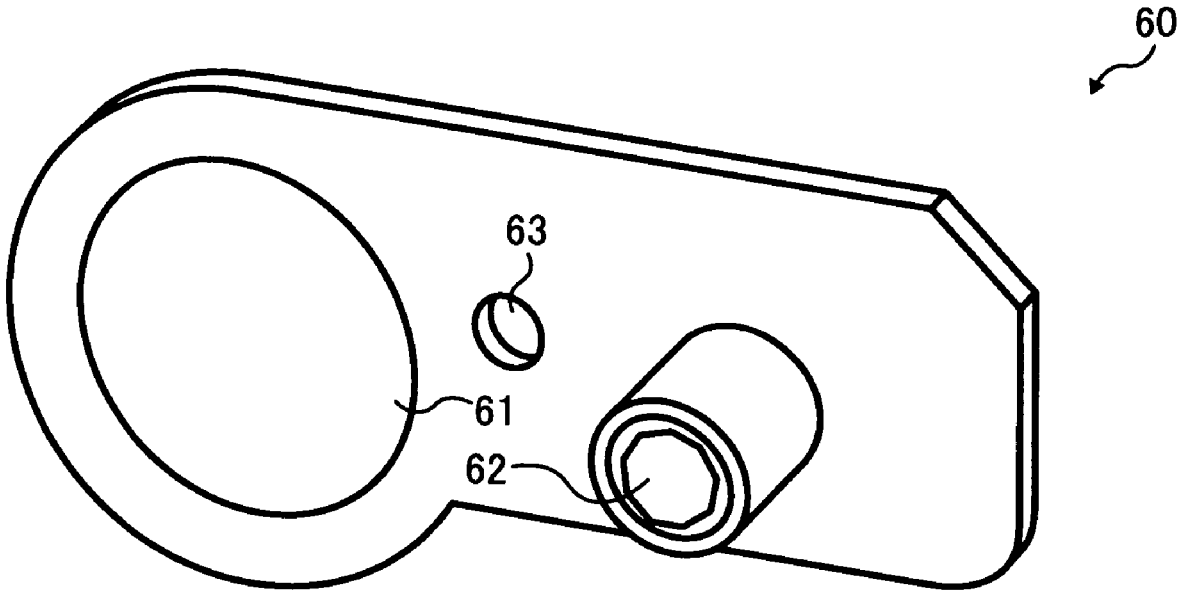
FIG. 11 is a schematic view illustrating a face plate based on which the developing module is positioned.

Next, the charging module 30 is incorporated into the housing 110 while positioned using a positioning plate of the housing 110. Further, the developing module 50 is then incorporated into the housing 110. The developing module 50 is incorporated into the housing 110, for example, using a face plate 60 as illustrated in FIG. 11. The face plate 60 has an opening 61 to be engaged with the outer surface of the bearing supporting the rotation shaft 11 of the photoreceptor 10. Thus, the face plate 60 is positioned relative to the rotation shaft 11 of the photoreceptor 10. In addition, the face plate 60 has an insertion opening 62, into which the shaft of the developing roller 52 of the developing module 50 is inserted, and a fixing hole 63 into which a screw is inserted to fix the face plate to the first plate 120 of the housing 110.

Figure 12:
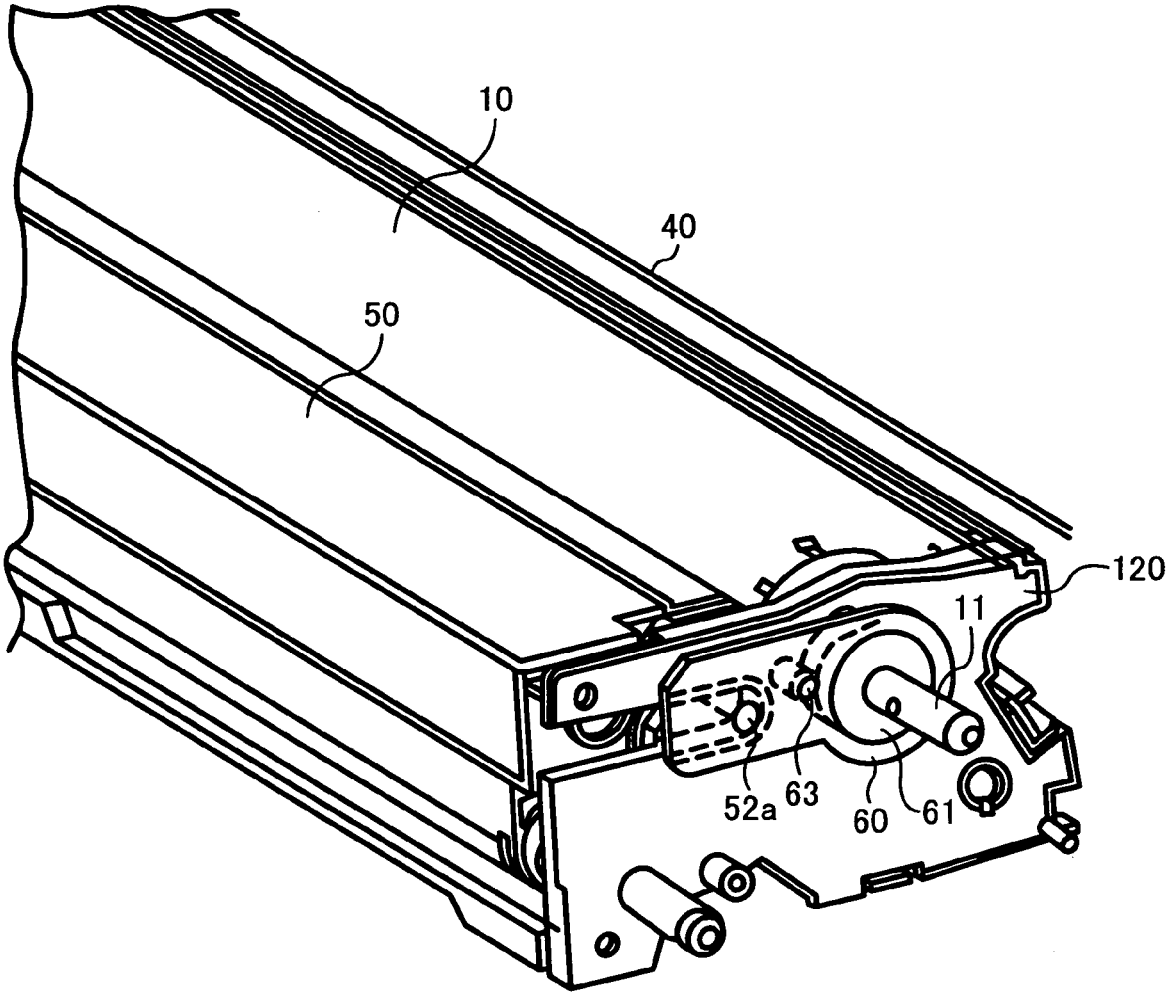
FIGS. 12 and 13 are schematic perspective views illustrating the process cartridge taken from the sides of the first side plate and the second side plate, respectively.

FIG. 12 is a perspective view illustrating the process cartridge, which is prepared by incorporating the cleaning module 40, charging module 30 and developing module 50 into the housing 110, from the side of the first side plate 120. FIG. 13 is a perspective view illustrating the process cartridge from the side of the second side plate 130.

As illustrated in FIG. 12, a shaft 52*a* of the developing roller 52 (i.e., developing sleeve) of the developing module is inserted into a guide groove provided in the first side plate 120 while the opening 61 of the face plate 60 is engaged with the bearing into which the rotation shaft 11 of the photoreceptor is inserted. Thus, the developing module 50 is positioned. Since the guide of the developing module 50 is fixed by the fixing hole 63, the developing module 50 is fixed to the housing 110. Although the charging module 30 is incorporated into the process cartridge, the charging module is not illustrated in FIG. 12 because of being hidden by the photoreceptor 10.

As illustrated in FIG. 13, the bearing of the agitating roller 57 of the developing module 50 is supported by a guide groove 131 of the second side plate 130 and the bearing of the shaft of the developing roller 52 is engaged with a hole 132. Thus, the developing module 50 on the side of the second side plate 130 is positioned.

After the photoreceptor 10 is rotatably set to the housing 110, a coupling 140 is provided on an end of the rotation shaft 11 of the photoreceptor 10 on the side of the second side plate 130. When the process cartridge 100 is attached to the image forming apparatus 200, the coupling 140 is engaged with a driving device (not shown) provided on the main body of the image forming apparatus 200.

The method for assembling the process cartridge of the present invention is characterized by setting the lubricant application module including the smoothing blade 21, solid lubricant 22, and brush roller 23 to the housing 110 followed by setting the photoreceptor 10, and then setting the cleaning module 40, which includes the cleaning blade 41 which is easily damaged. Therefore, it is possible to prevent the photoreceptor 10, smoothing blade 21 and cleaning blade 41 from being damaged without causing a problem in that one or more of the constituent devices are not accidentally set to the housing 110. Therefore, the thus assembled process cartridge 100 and the image forming apparatus 200 using the process cartridge can produce high quality images without abnormal images.

In this embodiment, when the lubricant application module 20 is set to the housing 110, the solid plasticizer 21, brush roller 23 and smoothing blade 21 are set in this order. However, the assembling order is not limited thereto. For example, a method in which at first the smoothing blade 21 is set to the housing 110, and then the solid lubricant 22 and the brush roller 23 are set thereto or a method in which at first the solid lubricant 22 is set to the housing 110, and then the smoothing blade 21 and the brush roller 23 are set thereto can also be used.

In this embodiment, the members constituting lubricant application module 20 are set before setting the photoreceptor 10. Therefore, when the photoreceptor 10 is set, whether or not all the members of the lubricant application module 20 are set can be visually determined, and thereby occurrence of a problem in that one or more of the members are omitted can be prevented. When the cleaning module 40 is set after the lubricant application module 20 is set and before the photoreceptor 10 is set, it is possible that the edge of the cleaning blade 41 is damaged by the photoreceptor 10. Therefore, the process modules such as the cleaning module 40, developing module 50 and charging module 30 are set after the photoreceptor 10 is set. The assembling order of the cleaning module 40, developing module 50 and charging module 30 is not particularly limited.

In this embodiment, the support plate 44 of the cleaning module 40 is preferably made of a material having a high mechanical strength so that the cleaning blade 41 is contacted with the surface of the photoreceptor 10 with high positional precision. The support plate 44 of the cleaning blade prevents the first and second side plates 120 and 130 and the housing 110 from being twisted and bent. Therefore, when the developing module 50 and/or the charging module 30 are set to the housing 110 after the cleaning module 40 is set thereto using the support plate 44 having a high rigidity, the influence of the cleaning module 40 on setting (i.e., twisting and bending) of the developing module 50 and the charging module 30 can be avoided. Therefore, the developing module 50 and the charging module 30 can be set with high positional precision. Thus, an even gap can be formed between the surface of the charging module 30 and the surface of the photoreceptor 10. Therefore, the amount of discharge products such as ozone generated during the charging process can be reduced and in addition the life of the photoreceptor can be prolonged. Further, an even gap can be formed between the surface of the photoreceptor and the surface of the developing roller 52, and thereby high quality images can be produced.

The process cartridge of this embodiment can optionally have a temperature and humidity sensor configured to measure the temperature and humidity in the process cartridge, a potential sensor configured to measure the potential of the surface of the photoreceptor 10 and a toner concentration sensor configured to determine the amount of the toner constituting a toner image formed on the surface of the photoreceptor. Further, the process cartridge optionally has a pre-transfer discharger and a pre-cleaning discharger, which are configured to reduce the potential of the photoreceptor before the transferring process and the cleaning process, respectively.

In this embodiment, when the solid lubricant 22 is set to the housing 110, a method in which at first only the cartridge case of the lubricant is set and then the solid lubricant is set to the cartridge case can also be used.

Figure 14:
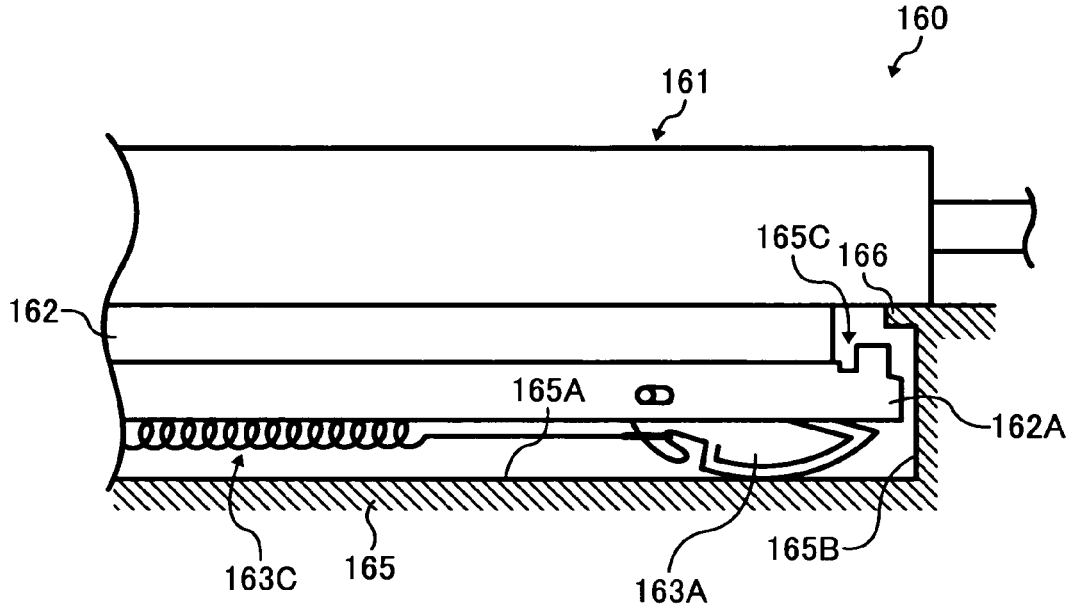
FIG. 14 is a schematic view illustrating lubricant application module, which is set in a housing.

FIG. 14 is a cross section illustrating a lubricant application module 160, which is set in the housing. As illustrated in FIG. 14, at first a solid lubricant 162 supported by a lubricant support 162A is set to a cartridge case 165, and then a brush roller 161 is set thereto so that the brush roller is contacted with the top surface of the solid lubricant 162. As illustrated in FIG. 14, in the cartridge case 165 the solid lubricant 162 is supported by the lubricant support 162A on which a spring 163C and a pair of moving members 163A (one of which is not shown) are provided.

The cartridge case 165 has a surface 165A which receives a force in the downward direction, which is a reactive force of the force applied to the moving members 163A in the upward direction; a surface 165B which prevents the lubricant support 162A from being dislocated in the horizontal direction (i.e., the right and left direction in FIG. 14, and the direction perpendicular to the sheet on which FIG. 14 is illustrated) by being contacted with the edge of the lubricant support 162A; and an opening 165C through which the solid lubricant 162 supported by the lubricant support 162A can pass and which faces the surface 165A.

Figure 15:
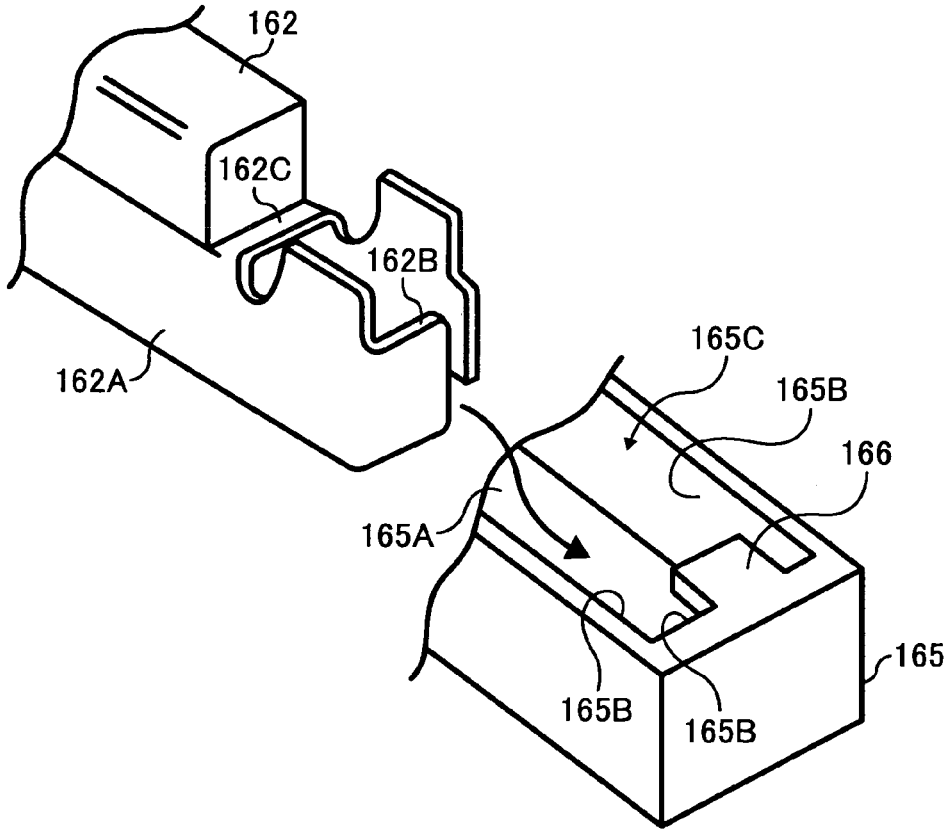
FIG. 15 is a perspective view illustrating the cartridge case.

When the solid lubricant 162 is set in the cartridge case 165 provided on the housing 110, at first the solid lubricant 162 is supported by the lubricant support 162A and then the spring 163C and the pair of moving members 163A are attached thereto. Next, as illustrated in FIG. 15, the lubricant support 162A is pressed into the cartridge case 165 from above to be set thereto. After the solid lubricant 162 is set to the cartridge case 165, the brush roller 161 is set on the solid lubricant 162.

When the brush roller 161 is set, the solid lubricant 162 receives a force from the spring 163C in such a direction as to fly out from the cartridge case 165. However, as illustrated in FIGS. 14 and 15, a projection 166, with which the lubricant support 162A is to be contacted, is provided on the longitudinal end portion of the opening 165C of the cartridge case 165, and therefore the lubricant support 162A is locked by the projection 166. Thus, the lubricant support 162A is prevented from moving upward. Therefore, the set solid lubricant 162 is prevented from flying out from the cartridge case without holding the lubricant with a hand, namely the solid lubricant 162 can maintain to have a temporarily fixed state.

When a contact portion 162B of the lubricant support 162A is on the same level as that of the upper surface of a lubricant supporting surface 162C, the entire solid lubricant cannot be exhausted, and a solid lubricant layer having the same thickness as that of the projection 166 remains on the lubricant supporting surface 162C, thereby incurring waste. Therefore, the lubricant support 162A has a configuration such that the level of the upper surface of the contact portion 162B is lower than the upper surface of the lubricant support surface 162C by a length not less than the thickness of the projection 166. In this case, the entire solid lubricant can be exhausted, and the solid lubricant can be minimized in size.

In this embodiment, the rotation shaft 11 of the photoreceptor 10 is separated, but the present invention is not limited thereto and a photoreceptor integrated with a rotation shaft can also be used.

Figure 16:
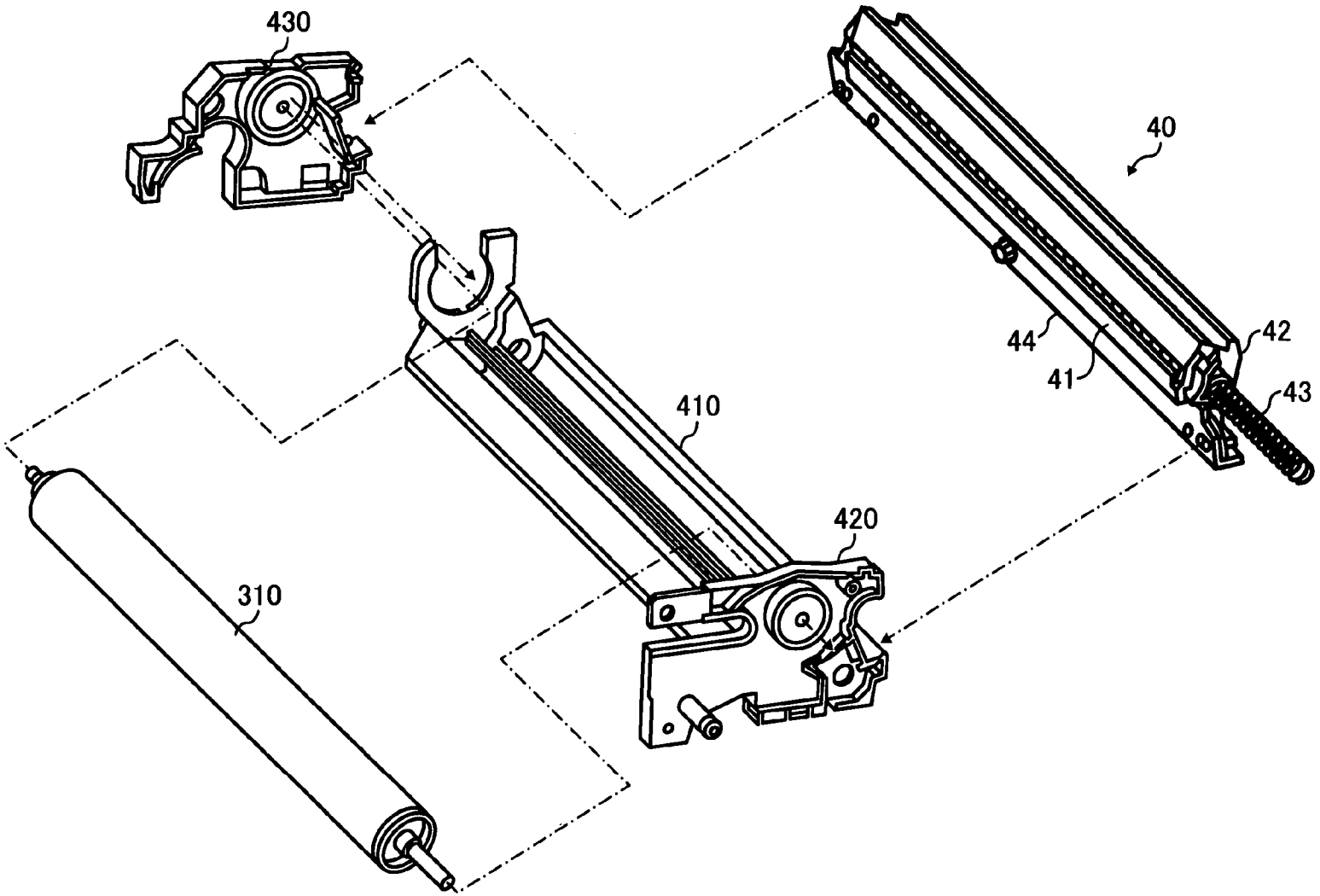
FIG. 16 is a schematic view for explaining another assembling method of the process cartridge of the present invention.

FIG. 16 a view illustrating the way to assemble the process cartridge when a photoreceptor 310 integrated with a rotation shaft is used. In this case, a housing which can be separated into two pieces is used. Specifically a combination of a side plate 430 and a housing 410 with another side plate 420 is used. The method for assembling the process cartridge is similar to that mentioned above referring to FIGS. 3-15.

The above-mentioned method for assembling the process cartridge can also be used for the case where the process cartridge is recycled. Hereinafter an example of the assembling method will be explained.

When a used process cartridge is recycled, the photoreceptor, cleaning blade, solid lubricant and smoothing blade are typically replaced with new ones. The smoothing blade is not replaced with new one, if it is not necessary.

For example, when the process cartridge 100 illustrated in FIG. 2 is used and then recycled, the photoreceptor 10, cleaning blade 41, solid lubricant 22 and smoothing blade 41 are replaced with new ones and the other members are reused. Specifically, the assembling procedure is as follows. The cleaning module 40, charging module 30 and developing module 50 are removed from the housing 110. Then the photoreceptor 10 is removed therefrom. Further, the brush roller 23, the solid lubricant 22 (only the support is removed) and the smoothing blade 21 are removed therefrom. Next, the assembling operation mentioned above is performed.

Specifically, a new solid lubricant 22 and a new brush roller 23 are set on the housing 110 on which the used smoothing blade 21 remains. Next, a new photoreceptor 10 is set thereto. Further, the cleaning module 40 in which the used cleaning blade 41 has been replaced with new one, the charging module 30 and the developing module 50 are set thereto.

By using this method, occurrence of a problem in that the photoreceptor, the smoothing blade and the cleaning blade are damaged can be prevented without causing a missing problem in that one or more of constituent members are not incorporated.

Another embodiment of the image forming apparatus of the present invention will be explained.

Figure 17:
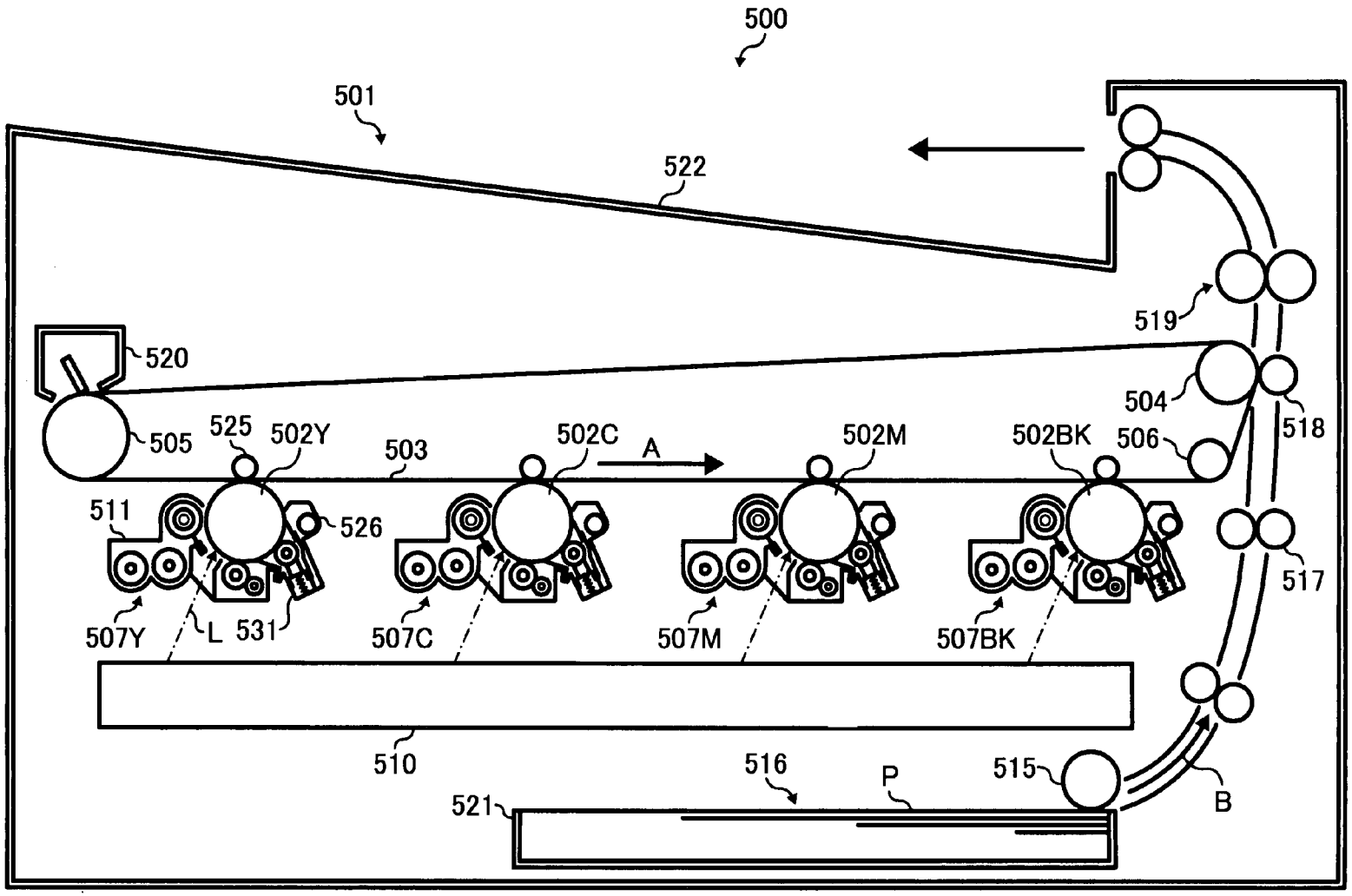
FIG. 17 is a schematic view illustrating another embodiment of the image forming apparatus of the present invention.

FIG. 17 is a cross section of another embodiment of the image forming apparatus of the present invention, which can produce full color images. An image forming apparatus 500 includes an endless intermediate transfer medium (belt) 503, which is rotated by rollers 504, 505 and 506 while stretched, and four process cartridges 507 (507Y, 507C, 507M and 507BK), which face the intermediate transfer belt 503. The process cartridges 507 include photoreceptors 502Y, 502C, 502M and 502BK, respectively, which have a cylindrical form and on which yellow, cyan, magenta and black toner images are formed, respectively. The color toner images are transferred onto the intermediate transfer belt 503 to be overlaid. The intermediate transfer medium has a belt form but is not limited thereto, and drum-form intermediate transfer mediums, etc. can also be used. Numeral 501 denotes a main body of the image forming apparatus 500.

Since the image forming operations of the process cartridges 507Y, 507C, 507M and 507BK are the same except that the color of the toner is different, only the process in which a yellow toner image formed by the process cartridge 507Y is transferred onto the intermediate transfer belt 503 will be explained.

Figure 18:
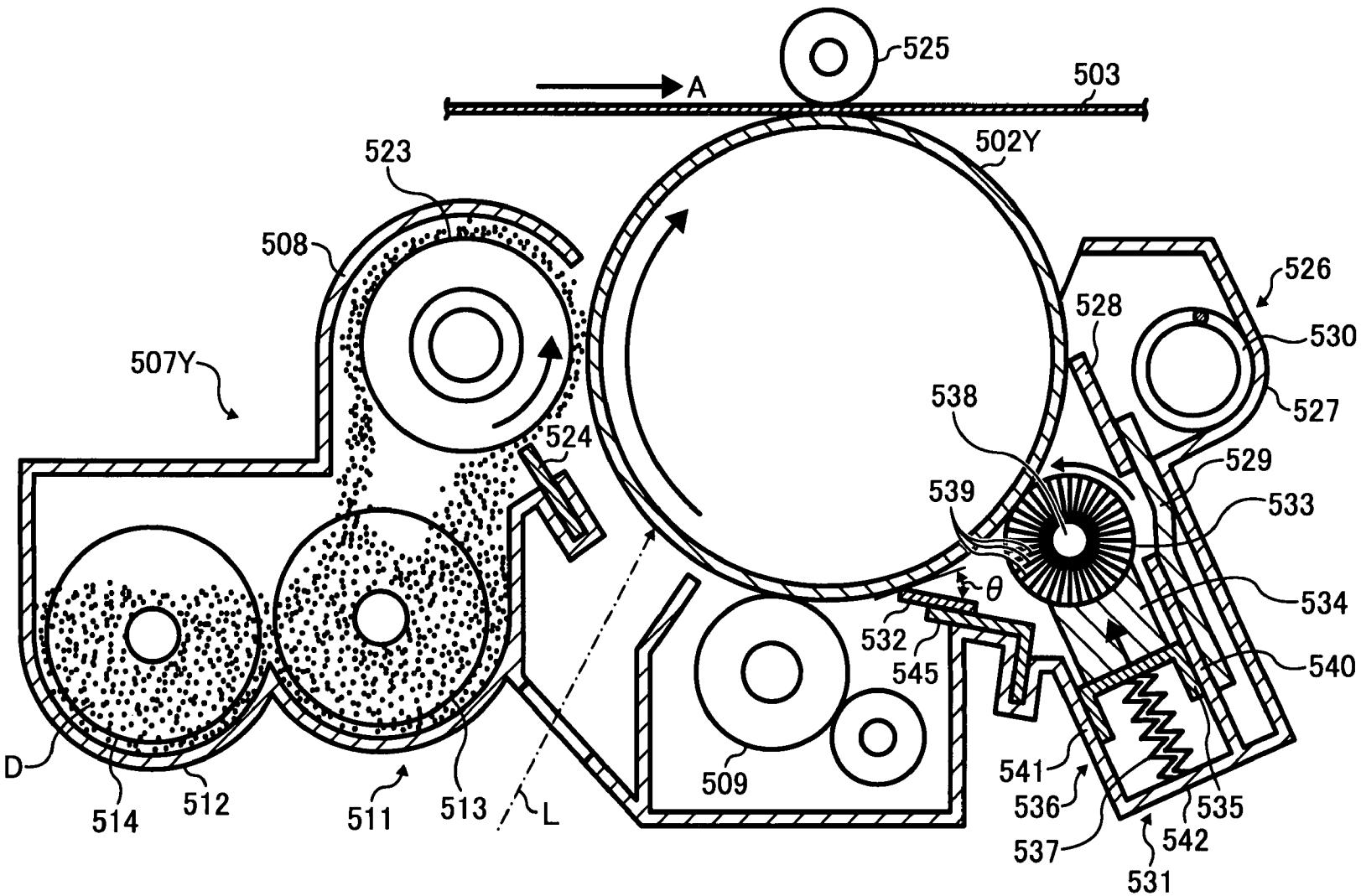
FIG. 18 is a schematic view illustrating another embodiment of the process cartridge of the present invention for use in the image forming apparatus illustrated in FIG. 17.

FIG. 18 is a cross section of the process cartridge 507Y. The photoreceptor 502Y is rotatably supported by a unit case 508 and is clockwise rotated by a driving device (not shown). A charging roller 509 applies a voltage to the photoreceptor 502Y to charge the photoreceptor so as to have a target potential with a predetermined polarity. A laser light beam L, which is emitted by an optical writing device 510 (illustrated in FIG. 17) and which is modulated according to image information, irradiates the charged photoreceptor 502Y to form an electrostatic latent image on the photoreceptor 502Y. A developing device 511 develops the electrostatic latent image with a yellow toner to form a yellow toner image on the photoreceptor 502Y.

The developing device 511 includes a case 512, which is a part of the unit case 508 and which contains a two component dry developer D including a toner and a carrier. In addition, two screws 513 and 514 configured to agitate and transport the developer D and a developing roller 523 which is counterclockwise rotated are arranged in the case 512. The developer D transported to the developing roller 523 by the screws 513 and 514 is transported toward the developing region, at which the photoreceptor 502Y faces the developing roller 523, while borne on the surface of the rotating developing roller. In this regard, the developer borne on the rotating developing roller 523 is scraped by a doctor blade 524, resulting in formation of a developer layer with a predetermined thickness on the developing roller 523. The toner in the developer D thus transported to the developing region is electrostatically transferred to the electrostatic latent image on the photoreceptor 502Y, resulting in formation of a yellow toner image on the photoreceptor 502Y. After passing the developing region, the developer D is separated from the developing roller 523 and is agitated again by the two screws 513 and 514. Thus, a toner image is formed on the photoreceptor 502Y. The developing device 507 is not limited to the developing device using a two component developer and may be a developing device using a one component developer.

A primary transfer roller 525 is provided so as to face the process cartridge 507Y with the intermediate transfer belt 503 therebetween. A transfer voltage is applied to the primary transfer roller 525 to primarily transfer the toner image on the photoreceptor 502Y to the intermediate transfer belt 503, which is rotated in the direction indicated by an arrow A. Toner particles remaining on the photoreceptor 502Y even after the primary transfer process are removed therefrom by a cleaning device 526. The cleaning device 526 includes a case 527 which is a part of the unit case 508, a cleaning blade 528 whose tip edge is contacted with the surface of the photoreceptor 502Y, a blade holder 529 configured to support the cleaning blade 526, and a toner feeding screw 530 which is provided in the case 527 and which is configured to feed the collected toner particles to the outside.

The blade holder 529 is fixed to the case 527, and the cleaning blade 528 is set so as to counter the rotating photoreceptor 502Y. The cleaning blade 528 is preferably made of a rubber such as urethane rubbers and silicone rubbers. A rear end of the cleaning blade 528 is fixed to the blade holder 529 using, for example, an adhesive. The tip edge of the cleaning blade 528 is pressure-contacted with the surface of the photoreceptor 502Y to scrape off residual toner particles on the photoreceptor. The toner particles thus scraped off are fed to the outside of the case by the toner feeding screw 530. Thus, the cleaning device 526 cleans the surface of the photoreceptor 502Y after the primary image transfer process. The cleaning member is not limited to a cleaning blade, and an electroconductive brush, which has a low to medium electric resistance and which applies a bias, can also be used as the cleaning member.

The process cartridge includes a lubricant application device 531 configured to apply a lubricant to the surface of the photoreceptor 502Y. The lubricant application device 531 will be explained later.

Similarly to the yellow toner image formation, cyan, magenta and black toner images are formed on the photoreceptors 502C, 502M and 502BK, respectively. The color toner images are sequentially transferred onto the yellow toner image on the intermediate transfer belt 503, resulting in formation of a multi-color image on the intermediate transfer belt. Toner particles remaining on the photoreceptors 502C, 502M and 502BK are also removed therefrom by respective cleaning devices.

As illustrated in FIG. 17, a paper cassette 521 containing sheets of a receiving material P such as papers, a feeding device 516 having a feeding roller 515 configured to feed the uppermost sheet of the receiving material P in the direction indicated by an arrow B. The thus fed receiving material is timely fed by a pair of registration rollers 517 to a secondary transfer nip formed by the intermediate transfer belt 503 and a secondary transfer roller 518. In this regard, a predetermined transfer voltage is applied to the secondary transfer roller 518 and thereby the multi-color toner image on the intermediate transfer belt 503 is transferred onto the receiving material P.

The receiving material P bearing the multi-color toner image thereon is fed to a fixing device 519 and the toner image is fixed to the receiving material P upon application of heat and pressure thereto. The receiving material P is then discharged to a tray 522. Toner particles, which remain on the intermediate transfer belt 503 even after the secondary image transfer process, are removed by a cleaning device 520.

In order to decrease the abrasion loss of the tip edge of the cleaning blade 528 and the surface of the photoreceptor 502Y and to well remove residual toner particles on the photoreceptor with the cleaning blade 528 even when the toner is a spherical toner, each of the process cartridges 507 has the lubricant application device 531. Since the lubricant application devices provided in the respective process cartridges 507 have the same configuration and perform the same operations, only the lubricant application device provided in the yellow process cartridge 507Y will be explained.

As illustrated in FIG. 18, the lubricant application device 531 includes a brush roller 533 which serves as a lubricant application member and which is set so as to be contacted with the surface of the photoreceptor 502Y, a solid lubricant 534 facing the brush roller 533, a lubricant holder 535 configured to fixedly support the solid lubricant, a guide 536 configured to guide the lubricant holder 535 supporting the solid lubricant 534, and a compression coil spring 37 configured to press the lubricant holder 535. The brush roller 533 includes a shaft 538 and a number of bristles whose rear ends are fixed on the shaft 538. The brush roller 533 is arranged so as to be parallel to the photoreceptor 502Y and the longitudinal end portions of the shaft 538 of the brush roller are rotatably supported by the unit case 508. As illustrated in FIG. 18, the brush roller 533 is counterclockwise rotated when an image forming operation is carried out. The brush roller 533 can be rotated clockwise. In this embodiment, the solid lubricant 534 is a bar or cuboid made of a material, which is prepared by melting a mixture of zinc stearate and additives such as lubricant oils and then cooling the mixture. The upper surface of the solid lubricant 534 is contacted with the brush of the brush roller 533 and the lower surface thereof is fixed to the holder 535. The guide 536 has a pair of guide plates 540 and 541 which are provided so as to be parallel to each other with an interval therebetween. The guide plates 540 and 541 are united by a connecting plate 542. Each of the guide plates 540 and 541 and the connecting plate 542 is a part of the unit case 508.

Figure 19:
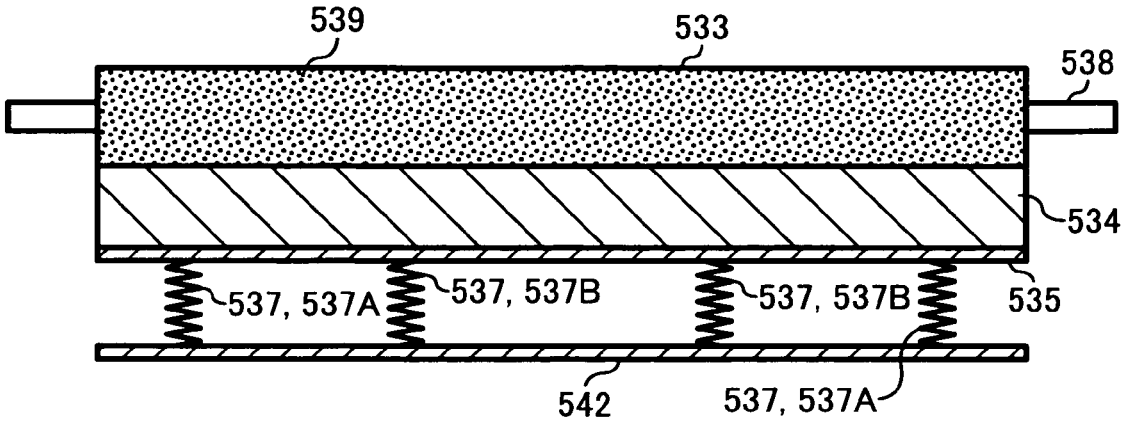
FIG. 19 is a schematic view illustrating the positional relationship among the brush roller, solid lubricant and compression coil spring of the lubricant applicator of the process cartridge illustrated in FIG. 18.

The lubricant holder 535 is arranged between the pair of guide plates 540 and 541 while slidably contacted therewith. The compression coil spring 537 includes plural coil springs as illustrated in FIG. 19, which are arranged between the connection plate 542 and the lubricant holder 535. Thus, the compression coil springs 537 press the solid lubricant 534 toward the brush roller 533 via the lubricant holder 535. Torsion coil springs and plate springs can be used instead of the compression coil springs.

As mentioned above, the solid lubricant 534 is pressure-contacted with bristles 539 of the brush roller 533 while the bristles 539 are contacted with the surface of the photoreceptor 502Y. Since the brush roller 533 is rotated, the surface of the solid lubricant 534 is scraped by the bristles 539 of the brush roller and the scraped solid lubricant (i.e., lubricant powder) is applied to the surface of the photoreceptor 502Y. Rollers which include a shaft and a layer of a foamed material located on the surface of the shaft can be used instead of the brush roller.

Since the surface of the solid lubricant 534 is scraped by the brush roller 534, the thickness of the solid lubricant decreases with time. However, since the solid lubricant 534 is pressed by the compression coil spring 537, the surface of the solid lubricant 534 is always contacted with the bristles 539 of the brush roller 533.

Specific examples of the materials for use as the solid lubricant include solid hydrophobic lubricants such as stearates (e.g., zinc stearate, barium stearate, lead stearate, iron stearate, nickel stearate, cobalt stearate, copper stearate, strontium stearate, calcium stearate, cadmium stearate, and magnesium stearate); oleates (e.g., zinc oleate, manganese oleate, iron oleate, cobalt oleate, lead oleate, magnesium oleate, and copper oleate); palmitates (e.g., palmitic acid, cobalt palmitate, copper palmitate, magnesium palmitate, aluminum palmitate, and calcium palmitate); other fatty acid and salts thereof (e.g., lead caprate, lead caproate, zinc linolenate, cobalt linolenate, calcium linolenate, and cadmium lycolinolenate); waxes (e.g., candelilla waxes, carnauba waxes, rice waxes, Japan waxes, jojoba oils, bees waxes, and lanoline; etc.

As illustrated in FIG. 19, the compression coil spring 537 has plural coil springs to press the lubricant holder 535. Numeral 537A denotes compression coil springs located on the longitudinal end portions of the solid lubricant 534 and numeral 537B denotes compression coil springs located on the longitudinal inner portions of the solid lubricant 534. It is preferable that the pressing force of the compression coil springs 537A is higher than that of the compression coil springs 537B. The same is true for the cases where other pressing devices are used instead of the compression coil springs. The reason therefor is as follows.

When only one compression coil spring is provided, it is impossible to uniformly coat the solid lubricant on the surface of the photoreceptor 502Y. Therefore, plural compression coil springs are used. However, when the pressing forces of the plural compression coil springs are the same, the pressure applied to the central portion of the solid lubricant 534 is greater than the pressure applied to the end portions thereof because the pressing force applied to the end portions tends to escape to the outside. Therefore, the solid lubricant tends to be unevenly coated on the surface of the photoreceptor 502Y. Therefore, by controlling the pressing force of the compression coil springs 537B so as to be lower than that of the compression coil springs 537A, the solid lubricant 534 can be contacted with the brush roller 533 at an even pressure, and thereby the solid lubricant can be evenly coated on the surface of the photoreceptor 502Y.

In FIG. 19, four compression coil springs are provided, but the number of springs is not limited thereto. It is preferable to provide two or more compression coil springs, and more preferably three or more compression coil springs. When two compression coil springs are provided on both longitudinal end portions of the lubricant holder 535, it is hard to contact the solid lubricant 534 with the brush roller 533 at an even pressure because the central portion of the solid lubricant is not pressed, and thereby it is hard to evenly coat the solid lubricant on the surface of the photoreceptor 502Y. Therefore, it is preferable to provide three or more compression coil springs so that the solid lubricant is pressed at an even pressure and thereby the solid lubricant is evenly coated on the surface of the photoreceptor 502Y.

As mentioned above referring to FIG. 18, the lubricant application device 531 includes the solid lubricant 534, and the brush roller 533 configured to apply the solid lubricant to the surface of the photoreceptor 502Y by being contacted with both the solid lubricant and the photoreceptor. The brush roller scrapes off the surface of the solid lubricant to produce a lubricant powder, and then applies the lubricant powder to the surface of the photoreceptor 502Y.

In addition, as illustrated in FIG. 18, the lubricant application device 531 includes the smoothing blade 532 which is located on the downstream side from the brush roller 533 relative to the rotation direction of the photoreceptor 502Y. The smoothing blade is preferably made of an elastic material such as rubbers, and the tip edge thereof is contacted with the surface of the photoreceptor so as to counter the rotating photoreceptor while the rear end portion thereof is fixed to the holder 545, which is fixed to the unit case 508. As illustrated in FIG. 18, the brush roller 533 is arranged on the downstream side from the cleaning blade 528 relative to the rotation direction of the photoreceptor 502Y. The cleaning device 526 cleans the surface of the photoreceptor before the lubricant is applied to the surface by the lubricant application device 531.

Since the process cartridge has such a configuration, toner particles remaining on the photoreceptor even after the image transfer process can be removed by the cleaning blade 528 and the solid lubricant 534 is applied to the cleaned surface of the photoreceptor 502Y. When the solid lubricant thus coated on the surface of the photoreceptor passes the smoothing blade 532, the lubricant is evenly spread, resulting in formation of a lubricant layer on the photoreceptor.

Since the lubricant is applied on the surface of the photoreceptor, the friction coefficient of the surface of the photoreceptor can be decreased, and thereby abrasion loss of the surface of the photoreceptor 502Y and the cleaning blade 528 can be reduced. In addition, even when a small-sized spherical toner is used, toner particles remaining on the surface of the photoreceptor can be efficiently removed. Further, since the lubricant is applied to the surface of the photoreceptor, followed by smoothing after the surface is cleaned, a problem in that the thickness of the lubricant layer varies, resulting in variation of the friction coefficient of the surface of the photoreceptor occurs, and thereby high quality images can be formed. Furthermore, since the smoothing blade 532 is set so as to trail the rotated photoreceptor as illustrated in FIG. 18, the lubricant application device can be miniaturized.

However, when a lubricant is merely applied to the surface of a photoreceptor, followed by smoothing, it is hard to form a lubricant layer with an even thickness. Therefore, it is possible that the resultant images have abnormal images such as omissions, blurred images and grainy images.

In order to prevent occurrence of such a problem, it is preferable that the smoothing blade 532 has a JIS-A hardness (defined in JIS K-6301) of not less than 79°. When the smoothing blade 532 has such a hardness, lubricant particles 550, which are prepared by scraping off the surface of the lubricant 534, can be evenly smoothed by the smoothing blade 532, and thereby a lubricant layer 551 with an even thickness can be formed on the photoreceptor 502Y. Therefore, the friction coefficient of the entire surface of the photoreceptor can be controlled to be constant. Therefore, formation of abnormal images such as omissions, blurred images and grainy images can be prevented. Further, since the friction coefficient can be controlled to be constant, occurrence of a blade-rolling problem in that the tip of the cleaning blade 528 contacting the surface of the photoreceptor is turned by the rotating photoreceptor in the opposite direction, resulting in defective cleaning can be prevented.

Figure 20:
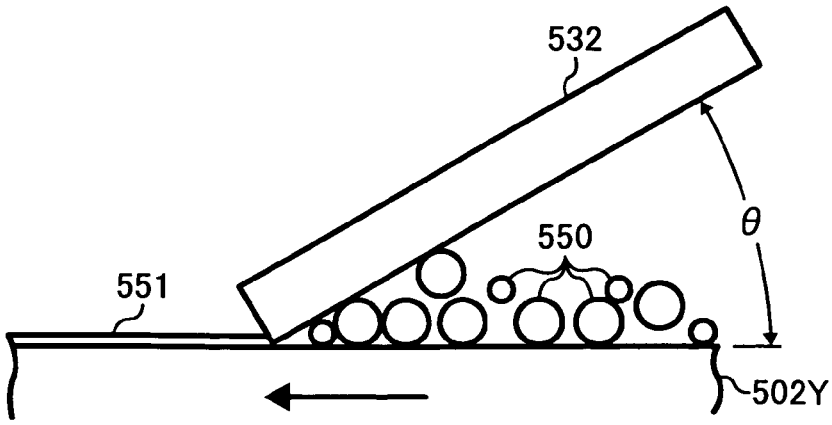
FIG. 20 is a schematic view illustrating how a lubricant is smoothed with a smoothing blade.

In this embodiment, it is preferable that the smoothing blade 532 is set so as to trail the photoreceptor; the contact angle (i.e., θ in FIGS. 18 and 20) formed by the blade 532 and the surface of the photoreceptor 502Y is preferably not less than 10°; and the contact pressure (linear pressure) is not less than 0.01 N/cm. In this case, the thickness of the lubricant layer formed on the surface of the photoreceptor can be securely uniformized. Therefore, formation of abnormal images can be prevented more securely.

The image forming apparatus illustrated in FIG. 18 is the process cartridge 507Y in which the image bearing member 502Y, the charging deice 509, the developing device 511, the cleaning device 526 and the lubricant application device 531 are assembled as a unit. The constituent elements of the process cartridge are not limited thereto, and the process cartridge includes at least an image bearing member and a lubricant applicator, and one or more of a charging device configured to charge the image bearing member, a developing device configured to develop a latent image with a developer to form a toner image, and a cleaning device configured to clean the surface of the image bearing member after the toner image transfer process, wherein the constituent elements are assembled as a unit.

Figure 21:
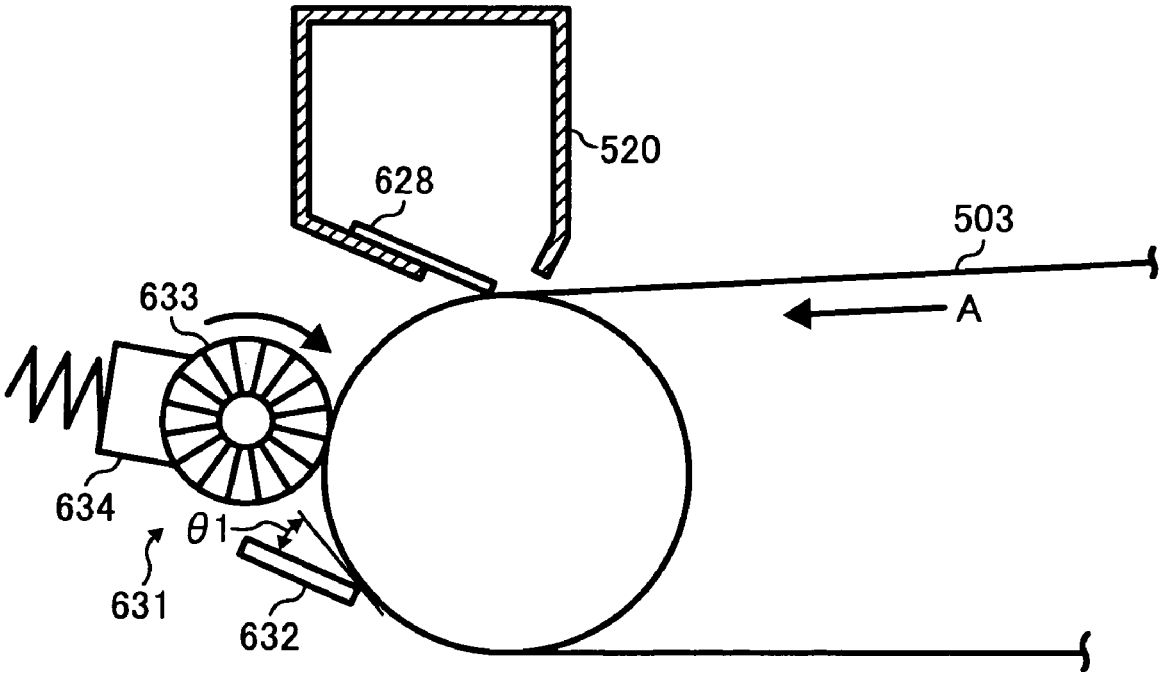
FIG. 21 is a schematic view illustrating a cleaner and a lubricant applicator which are provided to clean an intermediate transfer medium and to apply a lubricant thereto.

The lubricant application device can be used for the intermediate transfer medium as well as the photoreceptor. FIG. 21 illustrates a lubricant applicator 631 configured to apply a lubricant to the surface of the intermediate transfer belt 503 and the cleaning device 520 configured to clean the surface of the intermediate transfer belt 503. The cleaning device 520 includes a cleaning blade 628 which is pressure-contacted with the surface of the intermediate transfer belt 503 so as to counter the rotated intermediate transfer belt. The lubricant applicator 631 includes a solid lubricant 634, an application roller (i.e., a brush roller) 633, which is contacted with the surface of the intermediate transfer belt at a point on the downstream side from the cleaning blade 628 relative to the rotation direction of the intermediate transfer belt and is configured to apply the solid lubricant to the intermediate transfer belt after scraping the surface of the solid lubricant, and a smoothing blade 632 which is located on the downstream side from the brush roller 633 and is configured to smooth the applied lubricant. The smoothing blade 632 is pressure-contacted with the surface of the intermediate transfer belt 503 in such a manner as to trail the rotating intermediate transfer belt 503.

The smoothing blade 632 preferably has a JIS-A hardness (defined in JIS K-6301) of not less than 79°. In addition, the contact angle (i.e., θ1 in FIG. 21) formed by the blade 632 and the surface of the intermediate transfer belt is preferably not less than 10°, and the contact pressure (linear pressure) is preferably not less than 0.01 N/cm. In this case, a lubricant layer with an even thickness can be formed on the surface of the photoreceptor, and thereby the friction coefficient of the surface of the intermediate transfer belt 503 can be decreased. Therefore, the blade-rolling problem in that the tip edge of the cleaning blade 628 is turned in the opposite direction by the rotated intermediate transfer belt can be avoided and formation of abnormal images can be prevented.

In this application, a combination of the charging device, light irradiating device and developing device is sometimes referred to as a toner image forming device.

The lubricant application device for use in the present invention will be explained in detail referring to examples.

EXAMPLE 1

A urethane rubber sheet having a thickness of 1.8 mm, which is manufactured by Toyo Tire & Rubber Co., Ltd., was used as the cleaning blade 528. The cleaning blade was set in a process cartridge so as to be contacted with the surface of a photoreceptor at a contact pressure of 0.539±0.098 N/cm (55±10 g/cm) and a contact angle θ of 70°±10°. A brush roller having bristles, which are conductive polyester bristles having a length of 2.5 mm and manufactured by Tsuchiya, was used as the brush roller 533. The brush roller was set on the photoreceptor so that the photoreceptor digs into the bristles by 0.5 mm. In addition, a urethane rubber sheet having a thickness of 1.3 mm, which is manufactured by Toyo Tire & Rubber Co., Ltd., was used as the smoothing blade 532. The smoothing blade was set in a process cartridge so as to be contacted with the surface of a photoreceptor at a contact pressure of 0.02±0.01 N/cm and a contact angle θ of 15°±5°. The hardness (JIS-A hardness) of the smoothing blade was changed so as to be on several levels in a range of from 68° to 93°. Thus, process cartridges were prepared.

Each of the cartridges was set in an image forming apparatus IMAGIO NEO C325 manufactured by Ricoh Co., Ltd., and 1,000 white solid images were continuously produced under a normal environmental condition (laboratory condition) using a receiving paper of A4 size. In this case, the receiving paper was fed in a direction perpendicular to the longitudinal direction thereof. After the running test, the surface of the photoreceptor was observed to determine whether the lubricant is evenly coated on the photoreceptor.

The results are shown in Table 1 below. It is clear from Table 1 that when the smoothing blade has a JIS-A hardness of not less than 79°, the lubricant is evenly coated. When the hardness is not greater than 72°, the layer was grainy and is opaque.

TABLE 1

| | Hardness of smoothing blade | | | | |
|---|---|---|---|---|---|
| | 68° | 72° | 79° | 83° | 93° |
| Evenness of lubricant layer | Poor (grainy) | Poor (grainy) | Good | Good | Good |

EXAMPLE 2

A urethane rubber sheet having a thickness of 2 mm, which is manufactured by Bando Chemical Industries, Ltd., was used as the smoothing blade 532. The smoothing blade was set in a process cartridge so as to trail the rotating photoreceptor while being contacted with the surface of a photoreceptor at a contact pressure of 0.245±0.098 N/cm (25±10 g/cm), wherein the contact angle θ was changed from 0 to 90°.

A brush roller having bristles, which are conductive nylon bristles having a length of 3 mm and manufactured by Toei Sangyo, was used as the brush roller 533. The brush roller was set on the photoreceptor so that the photoreceptor digs into the bristles by 1 mm.

Thus, a lubricant applicator was prepared. A lubricant was applied on a photoreceptor using this lubricant application device and the lubricant application operation was continued for about 5 to 10 minutes so that a sufficient amount of lubricant was applied to the photoreceptor. This lubricant application operation was performed on the same photoreceptors while the contact angle was changed to produce several photoreceptors having different lubricant layers thereon. Several process cartridges were prepared using these photoreceptors.

Each of the cartridges was set in an image forming apparatus IMAGIO NEO C325 manufactured by Ricoh Co., Ltd., and 1,000 white solid images were continuously produced under an environmental condition of 35° C. 80% RH using a receiving paper of A4 size. In this case, the receiving paper was fed in a direction perpendicular to the longitudinal direction thereof. In the running test, the cleaning blade was observed to determine whether the cleaning blade causes the blade-rolling problem.

As a result, when the contact angle is not less than 10°, the blade-rolling problem is not caused.

The results are shown in Table 2.

TABLE 2

| Contact angle (°) | Occurrence of blade-rolling problem |
|---|---|
| 5 | Yes |
| 8 | Yes |
| 10 | No |
| 20 | No |
| 30 | No |
| 40 | No |
| 50 | No |
| 60 | No |
| 70 | No |
| 80 | No |

EXAMPLE 3

A urethane rubber sheet having a thickness of 1.6 mm, which is manufactured by Hokushin Corp., was used as the smoothing blade 532. The smoothing blade was set in a process cartridge so as to trail the rotating photoreceptor while being contacted with the surface of a photoreceptor at a contact pressure of 0.539±0.098 N/cm (55±10 g/cm), wherein the contact angle θ was changed from 0 to 90°.

A brush roller having bristles, which are conductive nylon bristles having a length of 2.5 mm and manufactured by Tsuchiya, was used as the brush roller 533. The brush roller was set on the photoreceptor so that the photoreceptor digs into the bristles by 0.5 mm.

Thus, a lubricant applicator was prepared. A lubricant was applied on a photoreceptor using this lubricant applicator and the lubricant application operation was continued for about 5 to 10 minutes so that a sufficient amount of lubricant was applied to the photoreceptor. This lubricant application operation was performed on the same photoreceptors while the contact angle was changed to produce several photoreceptors having different lubricant layers thereon. Several process cartridges were prepared using these photoreceptors.

Each of the cartridges was set in an image forming apparatus IMAGIO NEO C325 manufactured by Ricoh Co., Ltd., and 1,000 white solid images were continuously produced under an environmental condition of 35° C. 80% RH using a receiving paper of A4 size. In this case, the receiving paper was fed in a direction perpendicular to the longitudinal direction thereof. In the running test, the cleaning blade was observed to determine whether the cleaning blade causes the blade-rolling problem.

As a result, when the contact angle is not less than 10°, the blade-rolling problem is not caused.

The results are shown in Table 3.

TABLE 3

| Contact angle (°) | Occurrence of blade-rolling problem |
|---|---|
| 5 | Yes |
| 8 | Yes |
| 10 | No |
| 20 | No |
| 30 | No |
| 40 | No |
| 50 | No |
| 60 | No |
| 70 | No |
| 80 | No |

EXAMPLE 4

A urethane rubber sheet having a thickness of 1.5 mm, which is manufactured by Toyo Tire & Rubber Co., Ltd., was used as the smoothing blade 532. The smoothing blade was set in a process cartridge so as to trail the rotating photoreceptor while being contacted with the surface of a photoreceptor at a contact pressure of 0.196±0.098 N/cm (20±10 g/cm), wherein the contact angle θ was changed from 0 to 90°.

A brush roller having bristles, which are conductive nylon bristles having a length of 3 mm and manufactured by Tsuchiya, was used as the brush roller 533. The brush roller was set on the photoreceptor so that the photoreceptor digs into the bristles by 1 mm.

Thus, a lubricant applicator was prepared. A lubricant was applied on a photoreceptor using this lubricant applicator and the lubricant application operation was continued for about 5 to 10 minutes so that a sufficient amount of lubricant was applied to the photoreceptor. This lubricant application operation was performed on the same photoreceptors while the contact angle was changed to produce several photoreceptors having different lubricant layers thereon. Several process cartridges were prepared using these photoreceptors.

Each of the cartridges was set in an image forming apparatus IMAGIO NEO C325 manufactured by Ricoh Co., Ltd., and 1,000 white solid images were continuously produced under an environmental condition of 35° C. 80% RH using a receiving paper of A4 size. In this case, the receiving paper was fed in a direction perpendicular to the longitudinal direction thereof. In the running test, the cleaning blade was observed to determine whether the cleaning blade causes the blade-rolling problem.

As a result, when the contact angle is not less than 10°, the blade-rolling problem is not caused.

The results are shown in Table 4.

TABLE 4

| Contact angle (°) | Occurrence of blade-rolling problem |
|---|---|
| 5 | Yes |
| 8 | Yes |
| 10 | No |
| 20 | No |
| 30 | No |
| 40 | No |
| 50 | No |
| 60 | No |
| 70 | No |
| 80 | No |

EXAMPLE 5

A urethane rubber sheet having a thickness of 2 mm, which is manufactured by Bando Chemical Industries, Ltd., was used as the cleaning blade 528. The cleaning blade was set in a process cartridge so as to be contacted with the surface of a photoreceptor at a contact pressure of 0.196±0.098 N/cm (20±10 g/cm) and a contact angle θ of 75°±10°. A brush roller having bristles, which are conductive nylon bristles having a length of 3 mm and manufactured by Toei Sangyo, was used as the brush roller 533. The brush roller was set on the photoreceptor so that the photoreceptor digs into the bristles by 1 mm.

In addition, a urethane rubber sheet having a thickness of 1.5 mm, which is manufactured by Toyo Tire & Rubber Co., Ltd., was used as the smoothing blade 532. The smoothing blade was set in a process cartridge so as to be contacted with the surface of a photoreceptor at a contact angle θ of 15°±5° while the contact pressure was changed so as to be on several levels in a range of from 0.001 to 5.0 N/cm. Thus, process cartridges were prepared.

Each of the cartridges was set in an image forming apparatus IMAGIO NEO C325 manufactured by Ricoh Co., Ltd., and 1,000 white solid images were continuously produced under a normal environmental condition (laboratory condition) using a receiving paper of A4 size. In this case, the receiving paper was fed in a direction perpendicular to the longitudinal direction thereof. After the running test, inside of the process cartridges was observed to determine whether the inside of the process cartridges is contaminated by toner particles.

As a result, when the contact pressure is not less than 0.01 N/cm, the contamination problem is not caused.

The results are shown in Table 5.

TABLE 5

| Contact pressure (N/cm) | Occurrence of contamination problem |
|---|---|
| 0.001 | Yes |
| 0.005 | Yes |
| 0.01 | No |
| 0.05 | No |
| 0.1 | No |
| 0.5 | No |
| 1.0 | No |
| 5.0 | No |

EXAMPLE 6

A urethane rubber sheet having a thickness of 2 mm, which is manufactured by Hokushin Corp., was used as the cleaning blade 528. The cleaning blade was set in a process cartridge so as to be contacted with the surface of a photoreceptor at a contact pressure of 0.245±0.098 N/cm (25±10 g/cm) and a contact angle θ of 70°±10°. A brush roller having bristles, which are insulating polyester bristles having a length of 3 mm and manufactured by Toei Sangyo, was used as the brush roller 533. The brush roller was set on the photoreceptor so that the photoreceptor digs into the bristles by 1 mm.

In addition, a urethane rubber sheet having a thickness of 1 mm, which is manufactured by Toyo Tire & Rubber Co., Ltd., was used as the smoothing blade 532. The smoothing blade was set in a process cartridge so as to be contacted with the surface of a photoreceptor at a contact angle θ of 25°±5° while the contact pressure was changed so as to be on several levels in a range of from 0.001 to 5.0 N/cm. Thus, process cartridges were prepared.

Each of the cartridges was set in an image forming apparatus IMAGIO NEO C325 manufactured by Ricoh Co., Ltd., and 1,000 white solid images were continuously produced under a normal environmental condition (laboratory condition) using a receiving paper of A4 size. In this case, the receiving paper was fed in a direction perpendicular to the longitudinal direction thereof. After the running test, inside of the process cartridges was observed to determine whether the inside of the process cartridges is contaminated by toner particles.

As a result, when the contact pressure is not less than 0.01 N/cm, the contamination problem is not caused.

The results are shown in Table 6.

TABLE 6

| Contact pressure (N/cm) | Occurrence of contamination problem |
|---|---|
| 0.001 | Yes |
| 0.005 | Yes |
| 0.01 | No |
| 0.05 | No |
| 0.1 | No |
| 0.5 | No |
| 1.0 | No |
| 5.0 | No |

EXAMPLE 7

A urethane rubber sheet having a thickness of 1.6 mm, which is manufactured by Toyo Tire & Rubber Co., Ltd., was used as the cleaning blade 528. The cleaning blade was set in a process cartridge so as to be contacted with the surface of a photoreceptor at a contact pressure of 0.539±0.098 N/cm (55±10 g/cm) and a contact angle θ of 70°±10°. A brush roller having bristles, which are insulating polyester bristles having a length of 2.5 mm and manufactured by Tsuchiya, was used as the brush roller 533. The brush roller was set on the photoreceptor so that the photoreceptor digs into the bristles by 0.5 mm.

In addition, a urethane rubber sheet having a thickness of 1.3 mm, which is manufactured by Bando Chemical Industries, Ltd., was used as the smoothing blade 532. The smoothing blade was set in a process cartridge so as to be contacted with the surface of a photoreceptor at a contact angle θ of 22°±5° while the contact pressure was changed so as to be on several levels in a range of from 0.001 to 5.0 N/cm. Thus, process cartridges were prepared.

Each of the cartridges was set in an image forming apparatus IMAGIO NEO C325 manufactured by Ricoh Co., Ltd., and 1,000 white solid images were continuously produced under a normal environmental condition (laboratory condition) using a receiving paper of A4 size. In this case, the receiving paper was fed in a direction perpendicular to the longitudinal direction thereof. After the running test, inside of the process cartridges was observed to determine whether the inside of the process cartridges is contaminated by toner particles.

As a result, when the contact pressure is not less than 0.01 N/cm, the contamination problem is not caused.

The results are shown in Table 7.

TABLE 7

| Contact pressure (N/cm) | Occurrence of contamination problem |
|---|---|
| 0.001 | Yes |
| 0.005 | Yes |

TABLE 7-continued

| Contact pressure (N/cm) | Occurrence of contamination problem |
|---|---|
| 0.01 | No |
| 0.05 | No |
| 0.1 | No |
| 0.5 | No |
| 1.0 | No |
| 5.0 | No |

Next, a process cartridge (1) of the present invention in which the cleaning blade 528 is provided on the upstream side from the brush roller 533 relative to the rotation direction of the photoreceptor 502Y as illustrated in FIG. 18 is compared with a process cartridge (2) in which the cleaning blade 528 is provided on the downstream side from the brush roller 533 relative to the rotation direction of the photoreceptor 502Y.

The conditions of the lubricant application device and the cleaning device of the process cartridges (1) and (2) are described in Table 8.

TABLE 8

| | Process cartridge (1) | Process cartridge (2) |
|---|---|---|
| Cleaning blade | Urethane rubber blade with thickness of 1.3 mm | Urethane rubber blade with thickness of 1.3 mm |
| Location of cleaning blade 528 | Upstream side from brush roller | Downstream side from brush roller and smoothing blade |
| Manner of setting cleaning blade | Counter direction | Counter direction |
| Brush roller | Insulating PET | Insulating PET |
| Pressure of brush roller | 1250 mN × 4 | 1250 mN × 4 |
| Smoothing blade | Urethane rubber blade with thickness of 1.3 mm | Urethane rubber blade with thickness of 1.3 mm |
| Location of smoothing blade 532 | Downstream side from brush roller | Downstream side from brush roller |
| Manner of setting smoothing blade | Trailing direction | Trailing direction |

By using the process cartridges (1) and (2) and a polymerization toner, copies of an image with image proportion of 50% were continuously produced to determine the amount of the lubricant needed for keeping the friction coefficient of the surface of the photoreceptor to be 0.2. As a result, the amount was 0.04 g/km for the process cartridge (1) and 0.35 g/km for the process cartridge (2).

Figure 22:
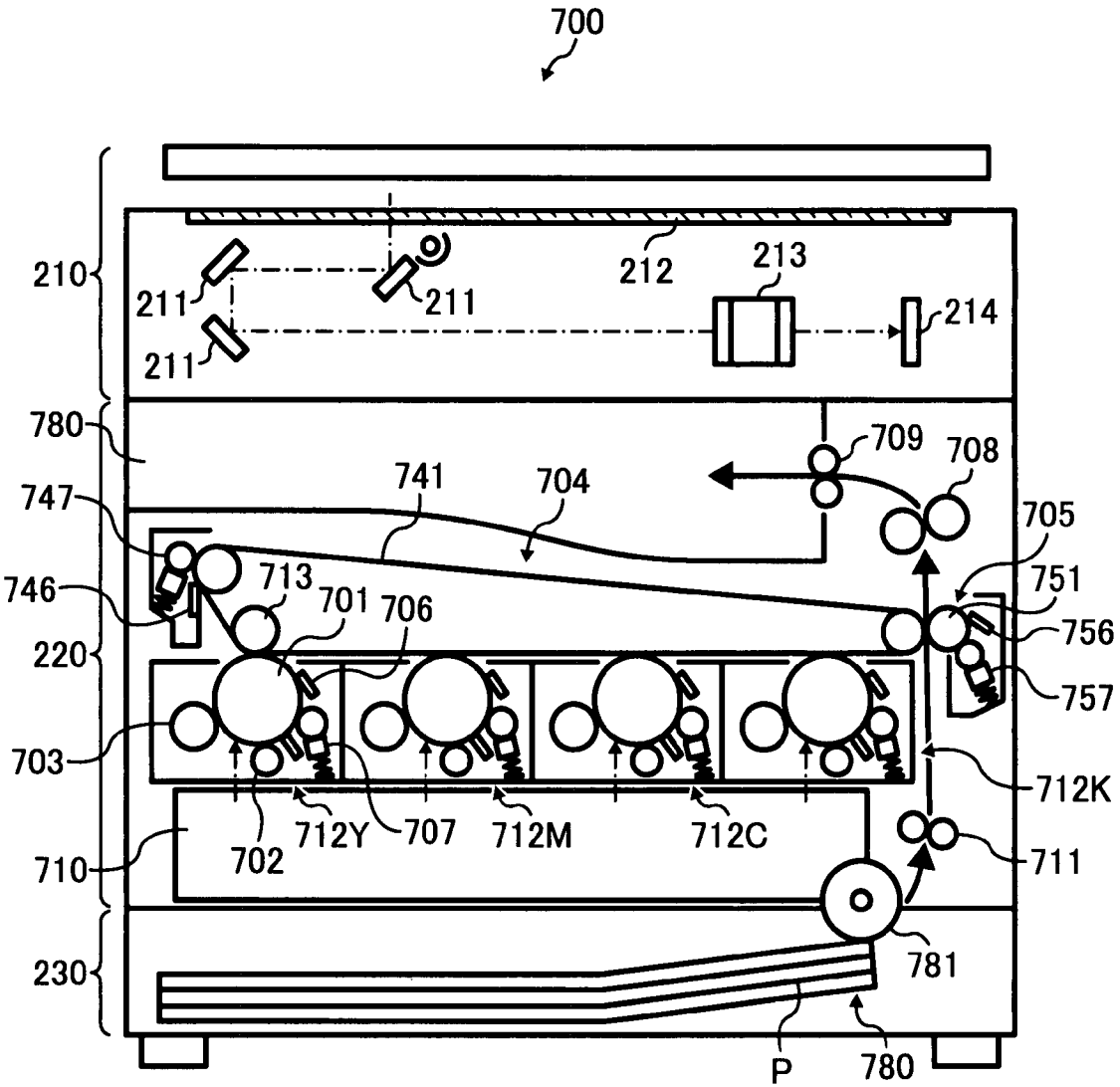
FIG. 22 is a schematic view illustrating yet another embodiment of the image forming apparatus of the present invention.
Figure 23:
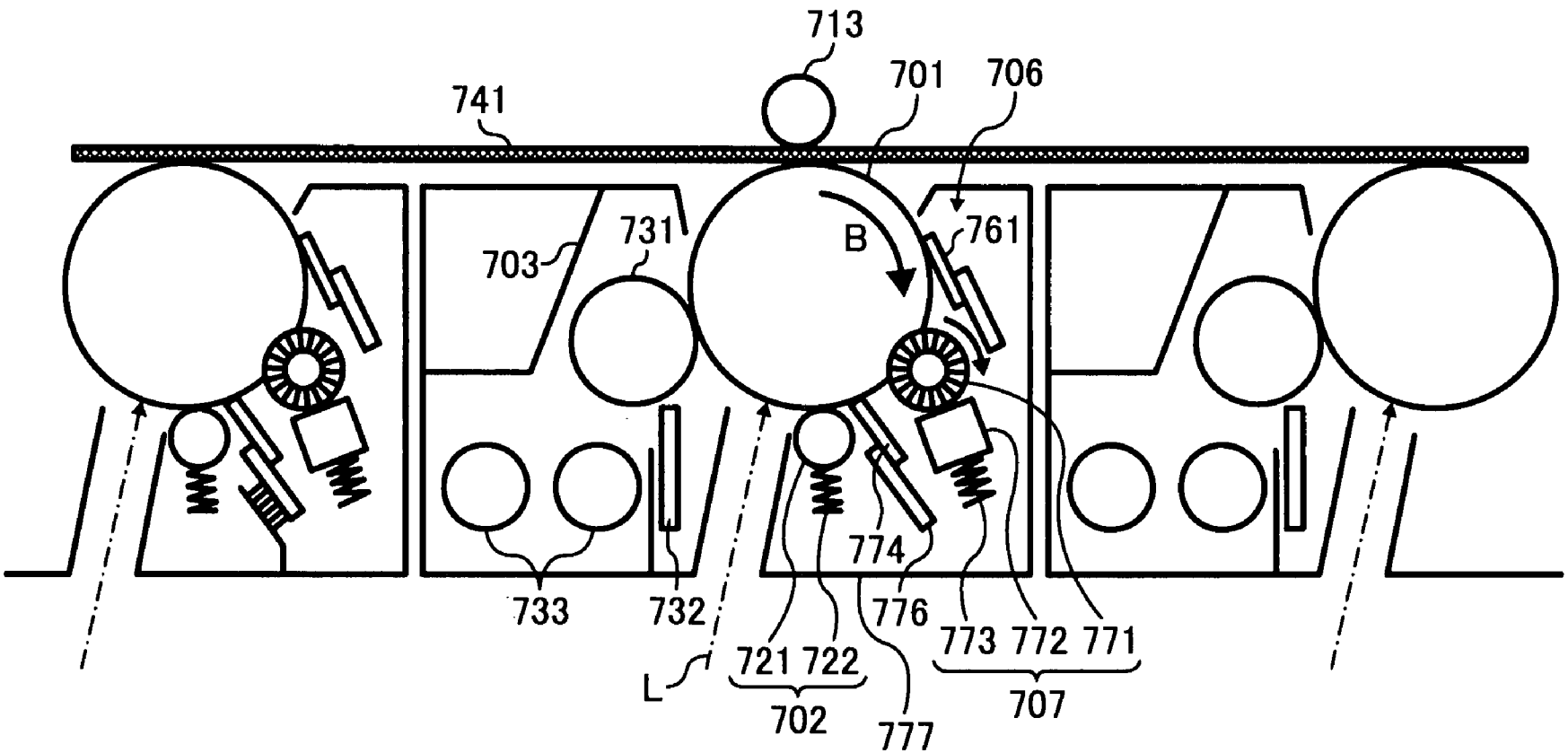
FIG. 23 is a schematic view illustrating another embodiment of the process cartridge of the present invention for use in the image forming apparatus illustrated in FIG. 22.

Therefore, it is clear from the results that the method in which a lubricant is applied to the surface of an image bearing member, followed by smoothing after a cleaning process has better friction decreasing effect than the method in which a lubricant is applied to the surface of an image bearing member, followed by smoothing before a cleaning process Next, a full color copier, which is another embodiment of the image forming apparatus of the present invention, will be explained referring to FIGS. 22 and 23.

FIG. 22 is a cross section illustrating a full color copier 700, which is an embodiment of the image forming apparatus of the present invention.

The full color copier is an image forming apparatus having an in-body discharge tray, in which the image forming section 220 is arranged in the center thereof, and the image reading section 210 configured to read an original image and the receiving material containing and feeding section 230 configured to feed a sheet of a receiving material P are provided above and below the image forming section 220. If desired, an additional receiving material containing and feeding section can be provided below the receiving material containing and feeding section 230. In addition, an in-body discharge tray 780 configured to store the discharged receiving material sheets thereon is provided at a location between the image reading section 210 and the image forming section 220.

The image forming section 220 includes four image forming units 712Y, 712M, 712C and 712K, which produce yellow, magenta, cyan and black color images, respectively. An intermediate transfer unit 704 including an endless intermediate transfer belt 741 is arranged above the four image forming units 712. In addition, a light irradiating device 710 is provided below the four image forming units 712. The suffixes Y, M, C and K represent the yellow, magenta, cyan and black colors, respectively, and are sometimes omitted when the color is not particularly limited. The same is true for other devices and members.

Around a photoreceptor 701 of each image forming unit 712, a charging device 702 configured to charge the photoreceptor 701, the light irradiating device 710 configured to irradiate the charged photoreceptor with image wise light to form an electrostatic latent image, and a developing device 703 configured to develop the electrostatic latent image with a developer including a toner to form a toner image on the photoreceptor 701 are provided. Further, a primary transfer roller 713 configured to transfer the toner image on the photoreceptor 701 to the intermediate transfer belt 704 is provided on the intermediate transfer belt 704 while facing the photoreceptor 701. Furthermore, a photoreceptor cleaning device 706 configured to remove and collect toner particles remaining on the surface of the photoreceptor 701 even after an image transfer process, and a photoreceptor-use lubricant applicator 707 configured to apply a lubricant to the surface of the photoreceptor 701 are also provided around the photoreceptor 701.

On the right side of the intermediate transfer unit 704, a secondary transfer device 705, which includes a secondary transfer roller 751 configured to transfer the toner image on the intermediate transfer belt 741 onto the receiving material P, is provided. In addition, the full color copier 700 includes an intermediate transfer medium cleaning device 746 configured to remove and collect toner particles remaining on the surface of the intermediate transfer belt 741 after the secondary transfer process; and an intermediate transfer medium-use lubricant application device 747 configured to apply a lubricant to the surface of the intermediate transfer belt 741, resulting in decrease of the friction coefficient of the surface of the intermediate transfer belt.

When toner particles are adhered to the secondary transfer roller 751, the back side of the receiving material sheet is soiled. Therefore, a secondary transfer member cleaning device 756 is provided to remove and collect toner particles adhered to the secondary transfer roller 751.

A fixing device 708 configured to fix the toner image on the receiving material P is provided on the down most stream side of the paper feeding passage. The receiving material P bearing the fixed image thereon is then discharged to the discharge tray 780 by a pair of discharge rollers 709.

In order to easily perform a maintenance operation, the image forming unit 712 includes the photoreceptor 701, charging device 702, developing device 703, photoreceptor cleaning device 706, etc., which are integrated as a unit so as to be detachedly attached to the image forming apparatus 700 (i.e., the full color copier). In addition, the intermediate transfer medium cleaning device 746 and the intermediate transfer medium-use lubricant application device 747 are unitized for the same reason, and the unit is detachably attached to the intermediate transfer belt 741. Alternatively, the intermediate transfer unit 704 may be a unit in which the intermediate transfer belt 741, the intermediate transfer medium cleaning device 746, and the intermediate transfer medium-use lubricant applicator 747 are unitized. In this case, the unit can be detachably attached to the full color copier 700 as a process cartridge. In addition, the secondary transfer roller 751, the secondary transfer member cleaning device 756 and a secondary transfer member-use lubricant applicator 757 are unitized and the unit is detachably attached to the full color copier 700.

The receiving material containing and feeding section 230 contains sheets of the receiving material P, and the uppermost sheet is fed by a roller 781 from a cassette 780 to a pair of registration rollers 711. After the registration rollers 711 temporarily stops the sheet P, the registration rollers are timely rotated to feed the sheet to the nip between the intermediate transfer belt 741 and the secondary transfer roller 751 so that the toner image on the intermediate transfer belt is transferred to a proper position of the sheet P.

In the image reading section 210, an image reading member, which includes a light source configured to emit light for illuminating an original image on a glass plate 212 and mirrors 211, moves back and forth to form a light image of the original image. The light image is sent to a CCD 214 through a lens 213. Then the image information is digitalized. According to the image information, a laser diode (not shown) of the light irradiating device 710 emits light pulses. The light pulses irradiate the charged photoreceptor 711 via a polygon mirror and lenses, resulting in formation of an electrostatic latent image on the photoreceptor 701.

FIG. 23 is an enlarged view illustrating the image forming section of the full color copier 700. In FIG. 23, character B denotes the rotation direction of the photoreceptor 701.

The charging device 702 includes a charging member 721 configured to charge the photoreceptor, and a pressure member 722 configured to press the charging member. The charging member 721 includes an electroconductive shaft and an elastic layer formed on the shaft. A voltage is applied to the shaft of the charging member 721 by a power source (not shown) so that the charging member applies a predetermined voltage to the photoreceptor 701, thereby charging the photoreceptor.

In the developing device 703, the developer is well agitated by agitation screws 733, and the developer is magnetically adhered to the surface of a developing roller 731. The developer thus adhered to the developing roller is scraped with a doctor 732 to form a thin developer layer on the developing roller 731. The developer layer on the developing roller develops the electrostatic latent image on the photoreceptor 701 at the developing region, resulting in formation of a toner image on the photoreceptor.

The toner image formed on the photoreceptor is then electrostatically transferred onto the intermediate transfer belt 741. Toner particles remaining on the surface of the photoreceptor without being transferred are removed by a photoreceptor cleaning blade 61.

A photoreceptor-use lubricant applicator 707 is provided on the downstream side from the photoreceptor cleaning device 706 relative to the moving direction of the photoreceptor. In addition, a lubricant application member 771 configured to apply a lubricant to the surface of the photoreceptor is provided on the downstream side from the photoreceptor cleaning blade 761, and a lubricant smoothing blade 774 is provided on the downstream side from the lubricant application member 771. When the image forming unit has such a configuration, it can be prevented to apply a solid lubricant on the surface of the photoreceptor on which toner particles remain. In addition, the lubricant applied on the surface of the photoreceptor by the lubricant application member 771 can be smoothed by the lubricant smoothing blade 774, resulting in formation of a lubricant layer. In this embodiment, the lubricant application member 771 is a brush roller in which a brush is formed on a metal shaft. A bar of a solid lubricant 772 is pressed toward the lubricant application member 771 by a pressing member 773. The lubricant application member 771 rotates and scrapes the solid lubricant 772, thereby forming a powder of the lubricant. The lubricant powder is applied to the surface of the photoreceptor 701. In this embodiment, the lubricant application member 771 rotates in the same direction as the rotation direction of the photoreceptor 701. The thus coated lubricant powder is pressed and spread by the smoothing blade 774 on the surface of the photoreceptor 701. Numeral 777 denotes a casing.

Specific examples of the solid lubricant 771 include the materials mentioned above for use as the lubricant 534.

As a result of an experiment performed by the present inventors, it is found that when the amount of the lubricant applied to the surface of the photoreceptor by the lubricant application member is too small, a case where the lubricant is not present on a portion of the surface of the photoreceptor arises. The smoothing member and cleaning member are directly contacted with the portion with no lubricant therebetween, thereby imposing a heavy burden on the photoreceptor, resulting in occurrence of an image misalignment problem in that the resultant image are distorted in the sub-scanning direction (i.e., in the rotation direction of the photoreceptor) and/or the resultant image is not formed on a proper position. This is because both the smoothing member and cleaning member are contacted with the surface of the photoreceptor whereas only a cleaning member is contacted with the surface of a photoreceptor in conventional image forming apparatuses. In particular, when the smoothing member and cleaning member are blades, the burden on the photoreceptor is seriously increased and thereby the distortion problem is easily caused.

Specifically, the present inventors' experiment is as follows.

A lubricant, zinc stearate, was coated on the surface of the photoreceptor by the brush roller. After 1000 images were formed using the photoreceptor, the images were observed to determine whether the images have abnormal images (1) due to increase of burden on the photoreceptor and another kind of abnormal images (2) due to adhesion of the lubricant to the charging member and/or the developing device. This image forming operation was repeated except that the coated weight of the lubricant is changed so as to be on several levels in a range of from 0.04 mg/m$^2$ to 1.50 mg/m$^2$. The results are shown in Table 9.

TABLE 9

| Weight of coated lubricant (mg/m$^2$) | Formation of abnormal images (1) | Formation of abnormal images (2) |
|---|---|---|
| 0.04 | Yes | No |
| 0.08 | Yes | No |
| 0.10 | Yes | No |
| 0.11 | No | No |
| 0.13 | No | No |
| 0.16 | No | No |
| 0.20 | No | No |
| 0.40 | No | No |

TABLE 9-continued

| Weight of coated lubricant (mg/m$^2$) | Formation of abnormal images (1) | Formation of abnormal images (2) |
|---|---|---|
| 0.60 | No | No |
| 0.80 | No | No |
| 0.90 | No | No |
| 1.00 | No | No |
| 1.15 | No | No |
| 1.20 | No | No |
| 1.30 | No | Yes |
| 1.45 | No | Yes |
| 1.50 | No | Yes |

It is clear from Table 9 that when the coated weight is less than 0.11 mg/m$^2$, abnormal images (misalignment images) due to increase of burden on the photoreceptor are frequently formed. In addition, it is found that the lower limit (i.e., 0.11 mg/m$^2$) is hardly influenced by the pressure of the smoothing member and cleaning member. Therefore, it is considered that when the coated weight is less than 0.11 mg/m$^2$, a lubricant-free portion is present on the surface of the photoreceptor regardless of the pressure of the smoothing member and cleaning member.

The coated weight was measure by the following method. After image formation, the photoreceptor was detached from the image forming apparatus. The lubricant present on the surface of a portion in a region of the photoreceptor, which region is located between the lubricant application member and the smoothing member at the time when the photoreceptor is detached, was scraped off to be weighed. The weight was divided by the area of the portion to determine the weight of the applied lubricant per unit area. The area of the portion from which the lubricant thereon is scraped off is not particularly limited.

In contrast, when the amount of the coated lubricant is too large, the lubricant layer formed by the smoothing member tends to have aggregates of the lubricant. Such aggregates do not produce the friction coefficient decreasing effect, and in addition are easily adhered to the charging member and developing roller, resulting in formation of abnormal images. In conventional image forming apparatuses in which a lubricant coated before a cleaning operation is scraped by a cleaning blade, such aggregates tend to be removed by the cleaning blade together with residual toner particles. However, in the image forming apparatus of the present invention, a lubricant is applied after a cleaning process. Therefore, aggregates of the lubricant easily pass through the smoothing member. The aggregates are easily transferred to the intermediate transfer medium in the primary image transfer process, and thereby the friction coefficient of the portion of the intermediate transfer medium is decreased. A toner image is hardly transferred to such a portion, and thereby abnormal images (omissions) are formed. Particularly, when the pressure of the smoothing member is relatively low compared to the pressure of a cleaning member, the aggregates are easily included in the resultant lubricant layer.

It is clear from Table 9 that when the coated weight of the lubricant is greater than 1.20 mg/m$^2$, a problem in that the lubricant is adhered to the charging member and/or the developing member is frequently caused. It is found that this upper limit is also hardly influenced by the pressure of the smoothing member. Although the mechanism therefor is not determined, it is considered to be that when a lubricant having a coating weight greater than a certain weight is scraped with a smoothing blade, the lubricant is slid at an inner portion thereof or an interface between the smoothing blade, and thereby aggregates easily pass through the smoothing blade regardless of the pressure of the smoothing blade. When an AC voltage is applied to the charging member to charge the photoreceptor, the lubricant adhesion problem in that the lubricant is adhered to the charging member is easily caused.

As mentioned above, in the image forming apparatus in which a lubricant application member is provided on the downstream side from a cleaning device and a lubricant smoothing member is provided on the downstream side from the lubricant application member, it is important to control the coating weight of the lubricant. JP-As 2000-33044.3, 2001-305907 and 2004-354695 include descriptions concerning the pressure of the smoothing member, but no description concerning the coating weight of the lubricant (i.e., the amount of the lubricant present in a region between the lubricant application member and the smoothing member).

Next, the toner for use in the image forming apparatus of the present invention will be explained.

In order to reproduce images with a resolution of not less than 600 dpi (dots per inch), the toner preferably has a weight average particle diameter (D4) of from 3 to 8 μm. When the toner has such an average particle diameter, the resultant images have good dot reproducibility because the toner size is much smaller than that of a minimum latent dot image. When the weight average particle diameter (D4) is too small, the transfer rate and blade cleanability of the toner deteriorates. In contrast, when the weight average particle diameter (D4) is too large, it becomes impossible to prevent occurrence of a scattering problem in that toner particles constituting images such as character images and line images are scattered.

In addition, the ratio (D4/D1) of the weight average particle diameter (D4) to the number average particle diameter (D1) of the toner is preferably from 1.00 to 1.40. As the ratio (D4/D1) approaches 1.00, the particle diameter distribution of the toner becomes sharp. A toner having such a relatively small particle diameter and a sharp particle diameter distribution has a uniform charge quantity. Therefore, by using such a toner, high quality images can be produced without causing a background development problem in that the background areas of images are soiled with toner particles. In addition, by using such a toner, the toner image transfer rate can be enhanced when a toner image is transferred from an image bearing member to a receiving material using an electrostatic transfer method.

The average particle diameter and particle diameter distribution of a toner can be measured, for example, by an instrument such as COULTER COUNTER TA-II or COULTER MULTISIZER II manufactured by Beckman Coulter Inc.

The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl or ISOTON-II manufactured by Beckman Coulter Inc.;
(2) 2 to 20 mg of a sample to be measured is added into the mixture;
(3) the mixture is subjected to an ultrasonic dispersion treatment for about 1 to 3 minutes; and
(4) the volume average particle diameter distribution and number average particle diameter distribution of the sample are measured using the instrument and an aperture of 100 μm.

In the present invention, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted.

The average circularity of the toner is preferably from 0.93 to 1.00. In this case, the effect of coating a lubricant can be enhanced. Specifically, even when a toner having such a high circularity is used, the problem in that toner particles remaining on an image bearing member pass through a cleaning blade, resulting in formation of background fouling can be avoided by coating a lubricant to the surface of the image bearing member.

In the present application, the circularity of a toner is determined by the following method using a flow-type particle image analyzer A-2100 from Sysmex Corp.

(1) at first 100 to 150 ml of water from which solid impurities have been removed is added to a container;
(2) then 0.1 to 0.5 ml of a surfactant serving as a dispersant is added thereto;
(3) further 0.1 to 9.5 g of a sample to be measured is added into the mixture;
(4) the mixture is subjected to an ultrasonic dispersion treatment for about 1 to 3 minutes to prepare a dispersion; and
(5) the concentration of the sample in the dispersion is controlled so as to be from 3000 to 10000 pieces/μl.

The suspension including toner particles to be measured is passed through a detection area formed on a plate in the measuring instrument; and the particles are optically detected by a CCD camera and then the shapes of the images of the particles are analyzed with an image analyzer.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The toner for use in the image forming apparatus of the present invention preferably has a first shape factor SF-1 of from 100 to 180 and a second shape factor SF-2 of from 100 to 180.

Figure 24A:
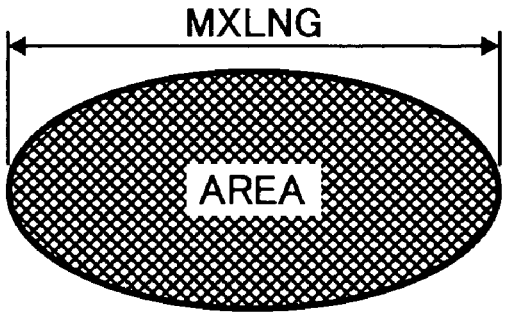
FIGS. 24A and 24B are schematic views for explaining how the shape factors of a toner are determined.
Figure 24B:
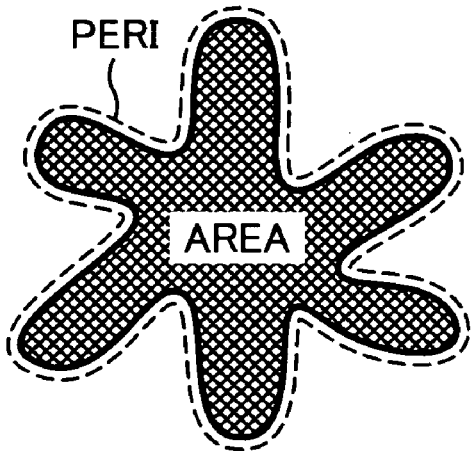

FIGS. 24A and 24B are schematic views for explaining the first and second shape factors SF-1 and SF-2, respectively.

As illustrated in FIG. 24A, the first shape factor SF-1 represents the degree of the roundness of a toner and is defined by the following equation (1):

$$SF\text{-}1=\{(MXLNG)^2/(\text{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. As the SF-1 increases, the toner particles have irregular forms.

As illustrated in FIG. 24B, the second shape factor SF-2 represents the degree of the concavity and convexity of a toner particle, and is defined by the following equation (2):

$$SF\text{-}2=\{(PERI)^2/(\text{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity. As the SF-2 increases, the toner particles have rougher surface.

The shape factors SF-1 and SF-2 are determined by the following method:

(1) particles of a toner are photographed using a scanning electron microscope (S-800, manufactured by Hitachi Ltd.); and (2) photograph images of 100 toner particles are analyzed using an image analyzer (LUZEX 3 manufactured by Nireco Corp.) to determine the SF-1 and SF-2.

When toner particles have a form near spherical form, the toner particles contact the other toner particles and the photoreceptor serving as an image bearing member at one point. Therefore, the adhesion of the toner particles to the other toner particles decreases and thereby fluidity of the toner can be enhanced. In addition, adhesion between the toner particles and the photoreceptor decreases, resulting in enhancement of the transferability of the toner particles. When the shape factors SF-1 and SF-2 are too large, the toner has poor transferability.

The toner for use in the present invention includes toner particles and an external additive having an average particle diameter of from 50 to 500 nm and an apparent density of not less than 0.3 g/cm$^3$, which is present on a surface of the toner particles. When the toner includes such an external additive, the toner has good cleanability. In particular, when the toner has a small particle diameter to produce high quality images, the developability and transferability of the toner can be improved.

Silica having an average primary particle diameter of from 10 to 30 nm and an apparent density of from 0.1 to 0.2 g/cm$^3$ is preferably used as the external additive.

When a particulate material having such proper properties is present on the surface of toner particles, a proper space is formed between the toner particles and a material such as photoreceptors. In addition, the area of a contact portion of such a particulate material contacted with toner particles, photoreceptors and charging members is very small, and thereby the particulate material can be evenly contacted therewith, resulting in decrease of the adhesion of the toner. Therefore, the developability and transferability of the toner can be enhanced. Further, the particulate material serves like a roller, and therefore the toner hardly abrades or damages the surface of the photoreceptor. Furthermore, even when toner particles having such a particulate material thereon are removed from the surface of a photoreceptor with a blade under high stress conditions (i.e., high load, high speed, etc.), the particulate material is not easily embedded into toner particles. Even when particulate material is slightly embedded into toner particles, the particulate material can be returned to the original position. Therefore, proper properties can be imparted to the toner and the properties can be maintained for a long period of time. Furthermore, the particulate material is slightly released from the toner particles, and the released particulate material is accumulated on the tip of the cleaning blade. The particulate material thus accumulated on the tip of the cleaning blade prevents residual toner particles from passing through a cleaning blade because of producing a dam effect.

Since such a particulate material decreases the shear force that the toner particles receive, a filming problem in that components having a low rheological property form a film on the surface of a member such as image bearing members can be avoided. Particularly, when a particulate material having an average primary particle diameter of from 50 to 500 nm is used, a good cleanability can be imparted to the toner. In addition, since the particle diameter is very small, the fluidity of the toner is not deteriorated. Further, when a surface-treated particulate material is added as an external additive and the particulate material contaminates the carrier used, the properties of the toner deteriorate to slight degree.

The average primary particle diameter of the particulate material present on the toner particles is from 50 to 500 nm and preferably from 100 to 400 nm. When the average primary particle diameter is too small, the particulate material tends to be located on recessed portions of toner particles, and thereby the particulate material cannot function as a roller (hereinafter referred to as roller-effect). In contrast, when the average primary particle diameter is too large, a problem in that residual toner particles easily pass through a cleaning blade occurs. This is because when such a large particle is adhered to the tip of a cleaning blade, a space on the order of toner particles is formed between the surface of the photoreceptor and the surface of the cleaning blade.

When the apparent density of the particulate material is too small, the toner and the particulate material tend to scatter or have high adhesion although the fluidity of the tone can be improved. Therefore, the roller effect and the dam effect of the particulate material deteriorate.

Specific examples of the inorganic materials for use as the particulate material include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)$, $Al_2O_3.2SiO_2$, $CaCO_3$, $MgCO_3$, $BaSO_4$, $SrTiO_3$, etc. Among these materials, $SiO_2$, $TiO_2$, $Al_2O_3$ are preferably used. These inorganic materials are preferably subjected to a hydrophobizing treatment using a compound such as coupling agents, hexamethyl disilazane, dimethyldichlorosilane, octyltrimethoxysilane, etc.

Specific examples of the organic materials for use as the particulate material include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination. Specific examples of the vinyl resins include homopolymers or copolymers of one or more vinyl monomers, such as styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

The apparent density of the particulate material is determined by the following method.

(1) a particulate material is gradually fed into a measuring cylinder with a volume of 100 ml, whose weight is previously measured, without vibrating the cylinder;

(2) after 100 ml of a particulate material is fed into the cylinder, the weight of the cylinder containing the particulate material is measured to determine the weight (W) of the particulate material; and (3) the apparent density of the particulate material is determined by the following equation:

$$\text{Apparent density (g/cm}^3\text{)} = W\text{(g/100 ml)}/100$$

When such a particulate material is adhered to toner particles, a method in which the particulate material is mechanically mixed with the toner particles to adhere the particulate material to the toner particles; and a method in which the particulate material and the toner particles are dispersed in a liquid using a surfactant, etc., to adhere to particulate material to the toner particles, followed by drying, can be used.

It is well known that various properties of toner influence the fixability of the toner. In addition, it is well known that among these properties, the T½flowing temperature (softening point, i.e., Mp in FIG. 25B) particularly relates to the fixability of the toner. As a result of the present inventors' experiment using the fixing device for use in the present invention, it is found that the T½flowing temperature of the toner used does not relate to the fixability of the toner image, and a toner having a glass transition temperature (Tg) of from 45 to 65° C. and a flow starting point of from 90 to 115° C. can produce images having good fixing property. When the glass transition temperature or the flow starting point is too low, an offset problem in that a part of a toner image on a receiving sheet is adhered to a fixing member and the image is retransferred to another portion of the sheet or another receiving sheet occurs. In contrast, when the glass transition temperature or the flow starting point is too high, the fixed toner image has poor fixing property, and a problem in that a part of or the entire toner image is peeled from the receiving sheet is caused.

In the present application, the glass transition temperature (Tg) was measured by a TG-DSC system TAS-100 manufactured by RIGAKU CORPORATION. The procedure for measurements of glass transition temperature is as follows:

1) a sample of about 10 mg is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature;
4) after the sample is allowed to settle at room temperature for 10 minutes; and
5) the sample is again heated under a nitrogen atmosphere from room temperature to 150° C. at a temperature rising speed of 10° C./min to perform a DSC measurement.

The glass transition temperature of the sample was determined using an analysis system of the TAS-100 system. Namely, the glass transition temperature is defined as the contact point between the tangent line of the endothermic curve at the temperatures near the glass transition temperature and the base line of the DSC curve.

Figure 25A:
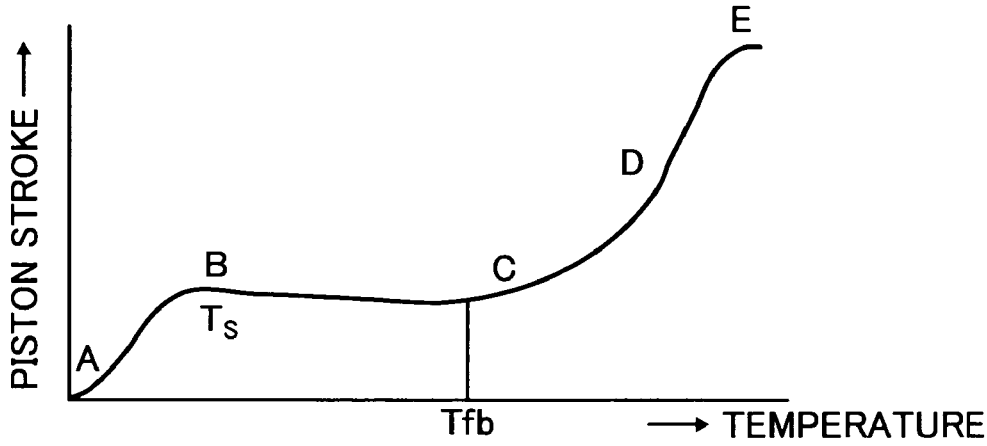
FIGS. 25A and 25B are graphs illustrating a melt flow curve of a material used for determining the thermal properties of the material.

The flow starting point of a toner is measured by a method based on JIS K7210 using a flow tester CFT500D manufactured by Shimadzu Corp. The measuring method is as follows:

(1) one (1) $cm^3$ of a toner sample is set in a cell and pressed by a pressure of 5 $Kg/cm^2$ while being heated at a temperature rising speed of 3.0° C./min to extrude the sample from a die of 10 mm in length, which has a nozzle of 1 mm in diameter and:
(2) graphing the relationship between temperature and the amount of drop of the piston as illustrated in FIG. 25A; and
(3) provided that the height of the thus prepared S-shaped curve is 2×, the flow starting point of the toner is defined as the temperature Tfb above which the piston moves.

Figure 25B:
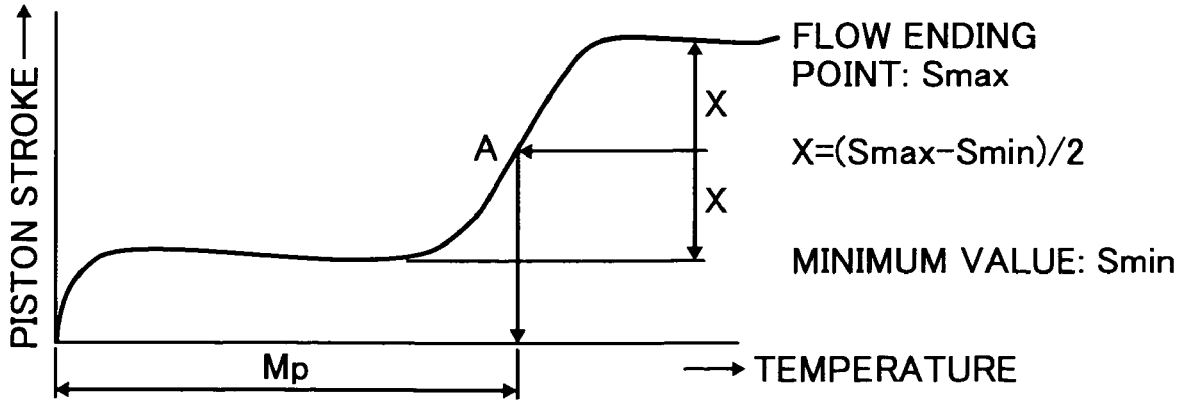

The temperature Mp illustrated in FIG. 25B is the melting point which is determined by a T½method and is defined as a temperature corresponding to the mid point of the flow ending point (Smax) and the minimum value (Smin).

Specific examples of the resins for use as the binder resin of the toner include the modified and unmodified polyester resins; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; etc. Other resins can be used in combination of the above-mentioned resins. Specific examples thereof include polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Among these resins, polyester resins are preferably used as the binder resin to impart good fixability to the toner.

Polyester resins are prepared by condensation-polymerizing an alcohol component with a carboxylic acid component.

Specific examples of the alcohol component include diols such as ethylene glycol, diethylene glycol, triethylene glycol, 1,2-propylene glycol, 1,3-propylene glycol, 1,4-butanediol, neopentyl glycol, and 1,4-butenediol; and dihydric alcohol monomers such as 1,4-bis(hydroxymethyl)cyclohexane, bisphenol A, hydrogenated bisphenol A, polyoxyethylenated bisphenol A, polyoxypropylenated bisphenol A, etherified bisphenol A, etc. In addition, dihydric alcohol derivatives in which these dihydric alcohols are substituted with a saturated or unsaturated hydrocarbon group having 3 to 22 carbon atoms and other dihydric alcohols can be used.

Specific examples of the carboxylic acid components include dibasic organic acid monomers such as maleic acid, fumaric acid, mesaconic acid, citraconic acid, itaconic acid, gultaconic acid, phthalic acid, isophthalic acid, terephthalic acid, cyclohexanedicarboxylic acid, succinic acid, adipic acid, sebacic acid, malonic acid, derivatives of these acids which are substituted with a saturated or unsaturated hydrocarbon group having 3 to 22 carbon atoms, anhydrides and low alkyl esters of these acids, dimers of linolenic acid and other dibasic organic acid monomers.

The polyester resins for use in the toner can include a unit obtained from one or more alcohol component and carboxylic acid components, which have three or more functional groups.

Specific examples of the tri- or more-hydric alcohols include sorbitol, 1,2,3,6-hexenetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethyl benzene, etc.

Specific examples of the carboxylic acid components and their acid anhydrides, which have three or more functional groups, include 1,2,4-benzentricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxyl propane, tetra(methylenecarboxyl)methane, 1,2,7,8-octanetetracarboxylic acid, trimer acids of embole, and anhydrides of these acids, etc.

The toner for use in the present invention can include a release agent so that the toner image is easily released from a fixing member such as fixing rollers and fixing belts in the fixing process. Any known release agents can be used as the release agent. Specific examples thereof include natural waxes such as vegetable waxes, e.g., carnauba waxes, cotton waxes, Japan waxes and rice waxes; animal waxes, e.g., bees waxes and lanolin; mineral waxes, e.g., montan waxes, ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used. These waxes can be used alone or in combination.

Among these waxes, carnauba waxes which are subjected to a free fatty acid removing treatment, montan waxes, oxidized rise waxes, and ester waxes can be preferably used. Among carnauba waxes, carnauba waxes which are microcrystalline and have an acid value of not greater than 5 mgKOH/g and which has an average particle diameter of not greater than 1 μm when dispersed in a binder resin are preferably used. Among montan waxes, montan waxes which are prepared by refining minerals and which are microcrystalline and have an acid value of from 5 to 14 mgKOH/g are preferably used. Among oxidized rice waxes, rice waxes which are prepared by subjecting rice waxes to an air oxidation treatment and which have an acid value of from 10 to 30 mgKOH/g are preferably used. When the acid value of the waxes is too low, the lowest fixable temperature increases, namely the toner has poor low temperature fixability. In contrast, when the acid value of the waxes is too high, the lower offset temperature below which the cold offset problem is caused increases, namely the toner has poor low temperature fixability.

The content of waxes in the toner is from 1 to 15 parts by weight, and preferably from 3 to 10 parts by weight, per 100 parts by weight of the binder resin included in the toner. When the content is too low, good release effect cannot be produced. When the content is too high, a spent toner problem in that toner particles are adhered to carrier particles is easily caused.

A charge controlling agent can be included in the toner to impart good charging ability to the toner. Any known charge controlling agents can be used. Suitable positive charge controlling agents include Nigrosine dyes, basic dyes, lakes of basic dyes, quaternary ammonium salts, etc. Suitable negative charge controlling agents include metal salts of monoazo dyes, metal complexes of salicylic acid, naphthoic acid and dicarboxylic acids, etc.

The content of the charge controlling agent in the toner is determined depending on the variables such as properties of the binder resin used, presence or absence of additives, and the dispersion method used. In general, the content of the charge controlling agent is preferably from 0.1 to 8 parts by weight, and more preferably from 0.1 to 2 parts by weight, per 100 parts by weight of the binder resin included in the toner. When the content is too low, the charge quantity (Q/M) of the toner largely changes when environmental conditions change. In contrast, when the content is too high, the toner has poor low temperature fixability.

Among monoazo dyes, metal-containing monoazo dyes such as chromium-containing monoazo dyes, cobalt-containing monoazo dyes, iron-containing monoazo dyes, and mixtures thereof are preferably used.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

By using these charge controlling agents, the charge (Q/M) rising property of the toner (developer) can be further improved. The content of such charge controlling agents is not unambiguously determined, but is generally from 0.1 to 10 parts by weight, and more preferably from 1 to 7 parts by weight, per 100 parts by weight of the binder resin included in the toner. When the content is too low, the charge controlling effect cannot be produced. In contrast, when the content is too high, the saturated charge quantity of the toner deteriorates.

Salicylic acid derivatives are preferably used as the charge controlling agent for color toners. If desired, transparent or white charge controlling agents are added in combination therewith. Specific examples thereof include, but are not limited thereto, organic boron compounds, fluorine-containing quaternary ammonium salts, calixarene compounds.

The toner can include a magnetic material so as to be used as a magnetic toner. Specific examples of the magnetic materials include iron oxides such as magnetite, hematite, and ferrite; metals such as iron, cobalt and nickel; metal alloys of a metal such as iron, cobalt and nickel with another metal such as aluminum, copper, lead, magnesium, tin, zinc, antimony, beryllium, bismuth, cadmium, calcium, manganese, selenium, titanium, tungsten, and vanadium; and mixtures of these materials. The magnetic materials preferably have an average particle diameter of from 0.1 to 2 μm. The content of the magnetic materials is from 20 to 200 parts by weight, and preferably from 40 to 150 parts by weight, per 100 parts by weight of the resin components included in the toner.

The toner for use in the image forming apparatus of the present invention includes a colorant. Suitable materials for use as the colorant include known dyes and pigments.

Specific examples of the black colorants include carbon black, aniline black, furnace black, lamp black, etc. Specific examples of the cyan colorants include Phthalocyanine Blue, Methylene Blue, Victoria Blue, Methyl Violet, aniline blue, ultramarine blue, etc. Specific examples of the magenta colorants include Rhodamine 6G Lake, dimethylquinacridone, Watchung Red, Rose Bengale, Rhodamine B, Alizarine Lake, etc. Specific examples of the yellow colorants include chrome yellow, BENZIDINE YELLOW G, BENZIDINE YELLOW GR, HANSA YELLOW 10G, HANSA YELLOW 5G, HANSA YELLOW G, HANSA YELLOW GR, HANSA YELLOW A, HANSA YELLOW RN, HANSA YELLOW R, NAPHTHOL YELLOW S, molybdenum orange, Quinoline Yellow, Tartrazine Lake, etc.

Other dyes and pigments which can produce yellow, magenta, cyan and black color image scan also be used. Specific examples thereof include Nigrosine dyes, black iron oxide, Cadmium Yellow, yellow iron oxide, loess, Titan Yellow, polyazo yellow, Oil Yellow, PIGMENT YELLOW L, PERMANENT YELLOW NCG, VULCAN FAST YELLOW 5G, VULCAN FAST YELLOW R, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake Y, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, metal-free Phthalocyanine Blue, Fast Sky Blue, INDANTHRENE BLUE RS, INDANTHRENE BLUE BC, Indigo, ultramarine, Prussian blue, Anthraquinone Blue, Fast Violet B, chalco-oil blue, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner for use in the present invention.

Specific examples of the resins for use as the binder resin of the master batches include polymers of styrene or styrene derivatives, copolymers of styrene with a vinyl monomer, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

The toner for use in the image forming apparatus of the present invention is preferably a polymerization toner which is prepared by subjecting a toner composition liquid, which includes at least a polyester prepolymer having a nitrogen-containing group, a polyester resin, a colorant and a release agent, to a crosslinking reaction and/or a molecular chain extension reaction in an aqueous medium.

Hereinafter the method for preparing such a polymerization toner will be explained in detail.

(Modified Polyester)

The toner for use in the image forming apparatus and process cartridge of the present invention preferably includes a modified polyester resin (i). In this application, the modified polyester resin is defined as a polyester resin which has a bond other than the ester bond or which includes therein another resin component which is bonded with the polyester resin component by a covalent bond, ionic bond or other bond. Specifically, the modified polyester resin is defined as a modified polyester resin prepared by incorporating a group such as an isocyanate group, which is reactive with a carboxyl group, and a hydroxyl group, at an end portion thereof, and then reacting the group with a compound having an active hydrogen atom.

Suitable modified polyester resins for use in the toner in the present invention include urea-modified polyester resins which are prepared by reacting a polyester prepolymer (A) having an isocyanate group with an amine (B). Polyester prepolymers (A) can be prepared by a polycondensation product of a polyol (PO) and a polycarboxylic acid (PC) (i.e., a polyester resin having a group including an active hydrogen atom) with a polyisocyanate (PIC). Specific examples of the group including an active hydrogen atom include hydroxyl groups (alcoholic hydroxyl group and phenolic hydroxyl group), amino groups, carboxyl groups, mercapto groups, etc. Among these groups, the alcoholic hydroxyl group is preferable.

Suitable polyols (PO) for use in preparing the modified polyester resin include diols (DIO), polyols (TO) having three or more hydroxyl groups, and mixtures of DIO and TO. Preferably, diols (DIO) alone or mixtures of a diol (DIO) and a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the modified polyester resin include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (1), anhydrides or lower alkyl esters (e.g., methyl esters, ethyl esters or isopropyl esters) of the polycarboxylic acids mentioned above can also be used as the polycarboxylic acid (PC).

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α, α, α',α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester resin for use as a binder resin of the toner of the present invention can be prepared by reacting a polyester prepolymer (A) having an isocyanate group with an amine (B).

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of a polyamine (B2) are preferably used.

The molecular weight of the urea-modified polyesters can be controlled using a molecular chain extension inhibitor, if desired. Specific examples of the molecular chain extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of the prepolymer (A) having an isocyanate group to the [NHx] group of the amine (B) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The urea-modified polyester resins for use in the toner can include a urethane bonding as well as a urea bonding. The molar ratio of the urea bonding to the urethane bonding is from 100/0 to 10/90, preferably from 80/20 to 20/80, and more preferably from 60/40 to 30/70. When the molar ratio of the urea bonding is too low, the hot offset resistance of the resultant toner deteriorates.

The modified polyesters (i) can be prepared, for example, by a method such as one-shot methods or prepolymer methods. The weight average molecular weight of the modified polyesters (i) is generally not less than 10,000, preferably from 20,000 to 1,000,000 and more preferably from 30,000 to 1,000,000. When the weight average molecular weight is too low, the polyester resins are hardly subjected to a molecular chain extension reaction, and thereby the resultant toner has poor elasticity. As a result, the hot offset resistance of the resultant toner deteriorates. In contrast, when the molecular weight is too high, the fixability of the toner deteriorates. In addition, the productivity of the toner deteriorates, specifically, the efficiency in a granulation process or a pulverization process deteriorates.

The number average molecular weight of the modified polyester resin (i) is not particularly limited if an unmodified polyester resin (ii) is used in combination therewith. Specifically, the weight average molecular weight of the modified polyester resin is mainly controlled rather than the number average molecular weight. When the modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner, the resultant toner has low glossiness.

The modified polyester resin (i) is prepared by subjecting a polyester prepolymer (A) to a crosslinking reaction and/or a molecular chain extension reaction using an amine (B). In this case, a reaction inhibitor can be used to control the molecular weight of the resultant modified polyester resin. Suitable materials for use as the reaction inhibitor include monoamines such as diethyl amine, dibutyl amine, butyl amine and lauryl amine, and blocked amines of the monoamines such as ketimine compounds.

(Unmodified Polyester)

In the present invention, it is preferable to use a combination of a modified polyester resin (i) with an unmodified polyester resin (ii) as the binder resin of the toner. By using such a combination, the low temperature fixability of the toner can be improved and in addition the toner can produce color images having a high glossiness.

Suitable materials for use as the unmodified polyester resin (ii) include polycondensation products of a polyol (PO) with a polycarboxylic acid (PC). Specific examples of the polyol (PO) and polycarboxylic acid (PC) are mentioned above for use in the modified polyester resin (i). In addition, specific examples of the suitable polyol and polycarboxylic acid are also mentioned above.

In addition, polyester resins modified by a bonding (such as urethane bonding) other than a urea bonding are considered as the unmodified polyester resin (ii) in the present application.

When a combination of a modified polyester resin (i) with an unmodified polyester resin (ii) is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (i/ii) of a modified polyester resin (i) to an unmodified polyester resin (ii) is from 5/95 to 80/20, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible to achieve a good combination of high temperature preservability and low temperature fixability.

The peak molecular weight of the unmodified polyester resin (ii) is from 1,000 to 10,000, preferably from 2,000 to 8,000 and more preferably from 2,000 to 5,000. When the peak molecular weight is too low, the high temperature preservability of the toner deteriorates. In contrast, when the peak molecular weight is too high, the low temperature fixability of the toner deteriorates.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too small, the resultant toner has poor high temperature preservability and poor low temperature fixability.

The unmodified polyester resin (i) preferably has an acid value of from 1 to 5 mgKOH/g, and more preferably from 2 to 4 mgKOH/g. When a wax having a high acid value is used as a release agent while a resin having a relatively low acid value is used as a binder resin, good charge properties and high volume resistivity can be imparted to the toner. The thus prepared toner can be preferably used for two component developers.

The binder resin for use in the toner preferably has a glass transition temperature (Tg) of from 35 to 70° C., more preferably from 45 to 65° C., and even more preferably from 55 to 65° C. When the glass transition temperature is too low, the high temperature preservability of the toner deteriorates. In contrast, when the glass transition temperature is too high, the low temperature fixability deteriorates. When the toner of the present invention includes a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners. This is because the urea-modified polyester resin is typically present on a surface of toner particles.

A particulate inorganic material is typically mixed with toner particles to assist in improving the fluidity, developing property and charging ability of the toner particles. It is preferable for the particulate inorganic materials to have a primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these particulate inorganic materials, a combination of a hydrophobic silica and a hydrophobic titanium oxide is preferably used. In particular, when a combination of a hydrophobic silica with a hydrophobic titanium oxide each having an average particle diameter not greater than 50 nm is used as an external additive, the electrostatic force and van der Waals' force between the external additive and the toner particles can be improved, and thereby the resultant toner has a proper charge quantity. In addition, even when the toner is agitated in a developing device, the external additive is hardly released from the toner particles, and thereby image defects such as white spots and image omissions are hardly produced. Further, the quantity of particles of the toner remaining on image bearing members can be reduced.

Titanium oxide exhibits high stability to withstand environmental conditions, and stably produce high density images. However, titanium oxide has a drawback in that the charge rising property of the toner deteriorates. Therefore it is not preferable that the content of titanium oxide is higher than that of silica. When the content of a hydrophobized titanium oxide is from 0.3 to 1.5% by weight, the charge rising property of the resultant toner hardly deteriorates. Therefore, images having good image qualities can be stably produced even when images are repeatedly produced.

Then the method for preparing the toner for use in the present invention will be explained.

(1) Preparation of Toner Composition Liquid

At first, a toner composition liquid is prepared by dissolving or dispersing toner constituents such as a colorant, an unmodified polyester resin, a prepolymer having an isocyanate group and a release agent in an organic solvent. The organic solvent is preferably a volatile solvent having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the solvent to the polyester prepolymer is generally from 0/100 to 300/100, preferably from 0/100 to 100/100 and more preferably from 25/100 to 70/100.

(2) Emulsification of the Toner Composition Liquid

The toner composition liquid is then dispersed in an aqueous medium in the presence of a surfactant and a particulate resin to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio of the aqueous medium to the toner composition liquid is generally from 50/100 to 2,000/100 and preferably from 100/100 to 1,000/100. When the added amount of the aqueous medium is too low, the toner composition liquid cannot be well dispersed, and thereby toner particles having a desired particle diameter cannot be prepared. Adding a large amount of aqueous medium is not economical.

When the toner composition liquid is emulsified, a dispersant such as surfactants and particulate resins are preferably included in the aqueous medium.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, amino alcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20)carboxylic acids and their metal salts, perfluoroalkyl(C7-C13)carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Particulate resins are added to the aqueous medium to stabilize the toner particles which are prepared in the aqueous medium. Any known resins which can form an aqueous dispersion can be used as the particulate resin. Specific examples of the resins include thermoplastic resins and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins and combinations thereof are preferably used because a resin dispersion including fine resin particles can be easily obtained. Suitable vinyl resins for use as the particulate resin include homopolymers and copolymers of vinyl monomers. Specific examples of the vinyl resins include styrene—(meth)acrylate copolymers, styrene—butadiene copolymers, (meth)acrylic acid—acrylate copolymers, styrene—acrylonitrile copolymers, styrene—maleic anhydride copolymers, styrene—(meth) acrylic acid copolymers, etc. The average particle diameter of the particulate resins is preferably from 5 to 200 nm, and more preferably from 20 to 300 nm.

In addition, inorganic compounds can be used as a dispersant. Specific examples of the inorganic compounds include tricalcium phosphate, calcium carbonate, titanium oxide, colloidal silica, and hydroxyapatite can be preferably used.

Further, it is preferable to stabilize the emulsion or dispersion using a polymer protection colloid in combination with the particulate resins and inorganic dispersants.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. and preferably from 40 to 98° C.

(3) Reaction of Polyester Prepolymer (A) with Amine (B)

When the toner composition liquid is added in an aqueous medium to prepare an emulsion, an amine is added to the mixture to react the amine with the polyester prepolymer having an isocyanate group. The reaction is accompanied with crosslinking and/or extension of the molecular chains of the prepolymer. The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and trioctyltin laurate can be used, if desired, for the reaction.

(4) Removal of Organic Solvent and Washing and Drying

After the reaction, the organic solvent is removed from the emulsion (i.e., the reaction product), followed by washing and drying. Thus, toner particles are prepared. In order to remove the organic solvent, the emulsion is gradually heated while the emulsion is agitated so as to have a laminar flow. In this case, it is preferable to remove the solvent in a certain temperature range while strongly agitating the emulsion, so that the resultant toner particles have a spindle form. When a dispersant, which can be dissolved in an acid or an alkali, such as calcium phosphate is used, it is preferable to dissolve the dispersant with hydrochloric acid to remove that from the toner particles, followed by washing. In addition, it is possible to remove such a dispersant by decomposing the dispersant using an enzyme.

(5) Addition of External Additive

Then a charge controlling agent is fixed on the thus prepared toner particles and an external additive such as particulate inorganic materials (e.g., silica and titanium oxide) is added thereto. If desired, a particulate lubricant can also be added thereto. These materials can be added by a method using a known mixer or the like.

By using such a method, a toner having a small particle diameter and a sharp particle diameter distribution can be easily prepared. By controlling the agitation during the solvent removing operation, the particle form of the toner can be easily changed from spherical forms to rugby-ball forms. In addition, the surface conditions of the toner particles can be controlled so as to have a surface of from smooth surface to rough surface like pickled plum.

Figure 26A:
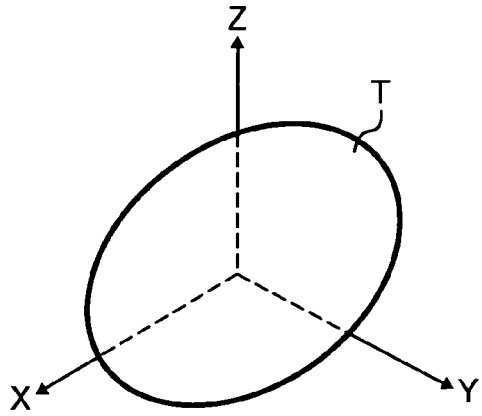
FIGS. 26A-26C are schematic views illustrating a toner particle.
Figure 26B:
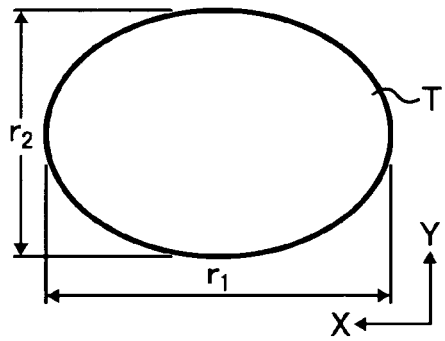
Figure 26C:
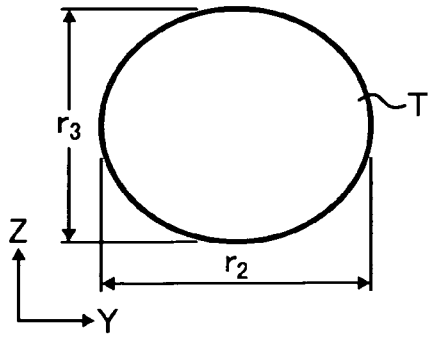

The toner for use in the present invention preferably has a form similar to the spherical form, and preferably satisfies the following relationships:

$$0.5 \leqq (r2/r1) \leqq 1.0 \text{ and } 0.7 \leqq (r3/r2) \leqq 1.0,$$

wherein r1, r2 and r3 represent the average major axis particle diameter, the average minor axis particle diameter and the average thickness of particles of the toner, wherein r3≦r2≦r1. The major axis particle diameter r1, the minor axis particle diameter r2 and the thickness r3 of a toner T are defined as illustrated in FIGS. 26A-26C.

When the ratio (r2/r1) is too small, the toner has a form far away from the spherical form, and therefore the toner has good cleanability, but the dot reproducibility and transfer efficiency deteriorate, resulting in deterioration of image qualities. In contrast, when the ratio (r2/r1) is too large, the toner has a form near the spherical form and therefore the cleaning problem tends to occur, particularly, under low temperature and low humidity conditions.

When the ratio (r3/r2) is too small, the toner has a flat form and therefore the toner does not cause the toner scattering problem because of being similar to a toner having an irregular form. However, such a toner is inferior to a spherical toner in transferability. In particular, when the ratio (r3/r2) is 1.0, the toner easily rotates on its major axis, resulting in improvement of the fluidity of the toner. Therefore the toner has good transferability and can produce high quality images. In addition, the toner can be well mixed with a carrier, and thereby the resultant two component developer has a narrow charge quantity distribution, thereby forming high definition images.

The above-mentioned size factors (i.e., r1, r2 and r3) of toner particles can be determined by observing the toner particles with a scanning electron microscope while the viewing angle is changed.

The thus prepared toner is used as a one component magnetic developer or a one component nonmagnetic developer or is used for a two component developer including the toner and a carrier.

When the toner is used for a two component developer, the toner is mixed with a carrier such as magnetic materials, and glass beads, which have a volume average particle diameter of from 10 to 1000 μm, and preferably from 20 to 100 μm. Suitable magnetic materials for use as the carrier include particles of iron, magnetites and ferrites including a divalent metal such as Mn, Zn and Cu. When the volume average particle diameter is too small, a problem in that carrier particles adhere to electrostatic latent images in a developing process occurs. In contrast, when the volume average particle diameter is too large, a problem in that the toner and the carrier are not well mixed, and thereby the toner is insufficiently charged with the carrier occurs, resulting in formation of images with poor image qualities. Among the carriers mentioned above, Cu-ferrites including Zn are preferably used because of having high saturation magnetization. However, a proper carrier is selected therefrom depending on the developing process used for the image forming apparatus for which the resultant developer is used.

The surface of the carrier is preferably coated with a resin. The coating resin is not particularly limited, but resins such as silicone resins, styrene—acrylic resins, fluorine-containing resins, and olefin resins are preferably used. Specific examples of the silicone resins include KR261, KR271, KR272, KR275, KR280, KR282, KR285, KR251, KR155, KR220, KR201, KR204, KR205, KR206, SA-4, ES1001, ES1001N, ES1002T, KR3093 which are manufactured by Shin-Etsu Chemical Co., Ltd.), SR2100, SR2101, SR2107, SR2110, SR2108, SR2109, SR2115, SR2400, SR2411, SH805, SH806A, SH840, (which are manufactured by Toray Silicone Industries, Inc.), etc.

The coating method is not particularly limited, but the following methods are preferably used:

(1) a resin solution in which a resin is dissolved in a solvent is sprayed on carrier particles, followed by drying; and (2) a particulate resin is electrostatically adhered to carrier particles, followed by melting of the resin upon application of heat thereto.

The coating method is not limited to spray coating, and other methods such as dip coating can also be used.

The thickness of the coating resin is generally from 0.05 to 10 μm and preferably from 0.3 to 4 μm.

This document claims priority and contains subject matter related to Japanese Patent Applications Nos. 2005-266567, 2006-195142, 2005-337461, 2005-296193, 2005-301564 and 2005-308238, filed on Sep. 14, 2005, Jul. 18, 2006, Nov. 22, 2005, Oct. 11, 2005, Oct. 17, 2005 and Oct. 24, 2005, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A process cartridge, comprising:

an image bearing member configured to bear a toner image on a surface thereof while rotating;

a lubricant applicator, comprising:

a lubricant application member configured to apply a solid lubricant to the surface of the image bearing member by contacting both a surface of the solid lubricant and the surface of the image bearing member, and a smoothing member configured to smooth the applied solid lubricant; and at least one member selected from a group consisting of a charging device configured to charge the image bearing member, a developing device configured to form the toner image on the image bearing member, and a cleaning device configured to clean the surface of the image bearing member after the toner image is transferred, wherein an amount of the solid lubricant present on a portion of the surface of the image bearing member, which is located between the lubricant application member and the smoothing member, is from 0.11 to 1.2 $mg/m^2$.

2. The process cartridge according to claim 1, wherein the smoothing member of the lubricant applicator is a smoothing blade arranged on the image bearing member so as to trail the rotating image bearing member.

3. The process cartridge according to claim 2, wherein an angle formed by the smoothing blade and the surface of the image bearing member is not less than 10°, and a pressure of the smoothing blade against the image bearing member is not less than 0.01 N/cm.

4. The process cartridge according to claim 1, including the cleaning device, wherein the cleaning device cleans the surface of the image bearing member before the lubricant application member applies the solid lubricant to the surface of the image bearing member.

* * * * *